US008039068B2

(12) United States Patent
Omata et al.

(10) Patent No.: US 8,039,068 B2
(45) Date of Patent: Oct. 18, 2011

(54) THERMAL TRANSFER IMAGE RECEIVING SHEET, AND METHOD FOR MANUFACTURING SAME

(75) Inventors: Takenori Omata, Tokyo-to (JP); Yoji Orimo, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 904 days.

(21) Appl. No.: 11/912,255

(22) PCT Filed: Apr. 20, 2006

(86) PCT No.: PCT/JP2006/308339

§ 371 (c)(1), (2), (4) Date: Oct. 22, 2007

(87) PCT Pub. No.: WO2006/115176

PCT Pub. Date: Nov. 2, 2006

(65) Prior Publication Data

US 2009/0061121 A1 Mar. 5, 2009

(30) Foreign Application Priority Data

Apr. 22, 2005 (JP) ..... 2005-125166
Sep. 28, 2005 (JP) ..... 2005-282723

(51) Int. Cl.
*B41M 5/40* (2006.01)

(52) U.S. Cl. ..... 428/32.38; 428/195.1; 428/446; 428/447

(58) Field of Classification Search ..... 428/32.38, 428/195.1, 446, 447
See application file for complete search history.

(56) References Cited

U.S. PATENT DOCUMENTS

| | | | | |
|---|---|---|---|---|
| 5,726,121 | A | 3/1998 | Uemura et al. | |
| 5,834,398 | A | 11/1998 | Mochizuki et al. | |
| 5,910,370 | A * | 6/1999 | Katsura et al. | 428/425.5 |

FOREIGN PATENT DOCUMENTS

| | | | |
|---|---|---|---|
| EP | 0 473 783 | A1 | 3/1992 |
| EP | 0 630 759 | A1 | 12/1994 |
| EP | 1 323 541 | A2 | 7/2003 |
| EP | 1 452 332 | A1 | 9/2004 |
| EP | 1 452 336 | A1 | 9/2004 |
| JP | 60-034898 | | 2/1985 |
| JP | 63-122593 | | 5/1988 |
| JP | 64-064888 | | 3/1989 |
| JP | 02-145397 | | 6/1990 |
| JP | 03-090385 | | 4/1991 |
| JP | 05-016539 | | 1/1993 |
| JP | 5-254263 | A | 10/1993 |
| JP | 5-309959 | A | 11/1993 |
| JP | 06-064345 | | 3/1994 |
| JP | 06-064346 | | 3/1994 |
| JP | 06-210971 | | 8/1994 |
| JP | 06-247062 | | 9/1994 |
| JP | 07-156563 | | 6/1995 |
| JP | 07-228064 | | 8/1995 |
| JP | 07-242070 | | 9/1995 |
| JP | 07-266723 | | 10/1995 |
| JP | 08-039946 | | 2/1996 |
| JP | 08-323943 | | 12/1996 |
| JP | 09-001943 | | 1/1997 |
| JP | 10-129130 | | 5/1998 |
| JP | 10-193812 | | 7/1998 |
| JP | 11-048626 | | 2/1999 |
| JP | 11-208127 | | 8/1999 |
| JP | 2000-218947 | | 8/2000 |
| JP | 2001-030639 | | 2/2001 |
| JP | 2001-138641 | | 5/2001 |
| JP | 2004-330442 | A | 11/2004 |
| JP | 2005-59245 | A | 3/2005 |
| WO | 01/94121 | A2 | 12/2001 |

OTHER PUBLICATIONS

European Search Report: dated Jan. 8, 2009; 06745520.4-2304/1876029 PCT/JP2006308339.
European Search Report: EP 09 17 6937.

* cited by examiner

*Primary Examiner* — Betelhem Shewareged
(74) *Attorney, Agent, or Firm* — Ladas & Parry LLP

(57) ABSTRACT

A thermal transfer image receiving sheet, excellent in releasability even after printing based on a thermal transfer process is performed a plurality of times, is provided. The thermal transfer image receiving sheet has: a substrate sheet; and an image receiving layer which is formed on the substrate sheet and having a binder resin, a high molecular weight silicone, and a low molecular weight-modified silicone. A kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

2 Claims, 4 Drawing Sheets

THERMAL TRANSFER IMAGE RECEIVING SHEET, AND METHOD FOR MANUFACTURING SAME

TECHNICAL FIELD

The present invention relates to a thermal transfer image receiving sheet used in an image forming method based on a thermal transfer process; and more specifically, to a thermal transfer image receiving sheet excellent in releasability even after an image is printed plural times.

The invention also relates to a thermal transfer image receiving sheet used in the state that the sheet is stacked on a thermal transfer sheet for sublimation transfer, and a method for manufacturing the same. Specifically, the invention relates to a thermal transfer image receiving sheet which can widely be used in fields of various color printers, such as a video printer, and is high in print density and good in productivity, and a method for manufacturing the same.

BACKGROUND ART

Hitherto, an image forming method based on a thermal transfer process has been known as one of the color or monochromic image forming techniques. The method has widely been used as a means making it possible to give high quality images with ease. The thermal transfer process is a process of preparing a thermal transfer sheet having a dye exhibiting a specific thermophysical property and using a thermal printing means such as a thermal head or a laser to transfer the dye from the thermal transfer sheet to a thermal transfer image receiving sheet, thereby forming an image. Such a thermal transfer process has advantages that the size of devices can be reduced and costs can be also reduced.

The thermal transfer process is roughly classified into two manners of a thermofusion manner and a thermal diffusion transfer manner on the basis for the mechanism of transferring a dye from a thermal transfer sheet to a thermal transfer image receiving sheet. The thermofusion manner is a manner of using a thermal transfer sheet having a thermally-melting dye and transferring the thermally-melting dye onto a thermal transfer image receiving sheet using the melting transfer mechanism occurred by thermal treatment, thereby forming an image. On the other hand, the thermal diffusion transfer manner is a manner of using a thermal transfer sheet having a thermally-diffusing dye and transferring the thermally-diffusing dye onto a thermal transfer image receiving sheet using the thermal diffusion transfer mechanism occurred by thermal treatment, thereby forming an image.

In the thermal diffusion transfer manner, the amount of the thermally-diffusing dye transferred onto the thermal transfer image receiving sheet can be arbitrarily adjusted by controlling the degree of the heating added to the thermal transfer sheet; therefore, the manner has features that an image which is excellent in reproducibility of intermediate colors and has a fine gradation can be formed and full color images are advantageously formed. Because of such advantages, thermal transfer technique in the thermal diffusion transfer manner is widely used in photographs for business use, printers for personal computers, video printers, and others.

Incidentally, a thermal transfer image receiving sheet used in such a thermal transfer manner is required to exhibit excellent releasability regarding a thermal transfer sheet in order to form a highly fine image. If its image receiving layer is low in releasability, a dye binder in the thermal transfer sheet is easily melted and bonded onto the image receiving layer. Thus, at the time of printing, release sounds may become large. As the case may be, the dye binder is completely melted and bonded thereto so as to cause a problem that a printed matter is not normally discharged from the printer, and other problems.

In particular, in the thermal transfer manner, images are formed ordinarily by subtractive color process; thus, dyes of yellow, magenta, and cyan are successively printed onto a thermal transfer image receiving sheet. Accordingly, onto the thermal transfer image receiving sheet, at least three printing processes are performed. It is therefore insufficient that the sheet is merely excellent in releasability, and it is necessary that the sheet has such release stability that excellent releasability can be kept in any one of the three printing processes. When a protective layer is transferred after the formation of the image in order to give durability thereto, it is necessary that the sheet is excellent in releasability in the three printing processes and further has adhesiveness onto the protective layer to be formed thereafter.

As a method of improving such releasability and release stability, there is generally used a method of incorporating a releasing agent having a function of improving the releasability into the image receiving layer.

Patent Document 1 discloses a method of adding a releasing agent made of a silicone oil to an image receiving layer in order to improve the releasability between a thermal transfer image receiving sheet and a thermal transfer sheet. Such a method makes it possible to improve the releasability because of the use of the silicone oil; however, the method has a problem that the release stability is insufficient. Moreover, when the image receiving layer is formed by a melt-extrusion process, the silicone oil bleeds out largely in the process so as to cause a problem of lowering the image quality of a printed image.

Furthermore, in the above-mentioned thermal transfer manner, a print image high in image quality is formed onto an image receiving layer at a high-speed. Usually, therefore, there is used a thermal transfer image receiving sheet, in which an image receiving layer made mainly of a resin which can be dyed (or a resin to which a dye can be bonded) is formed on a substrate sheet. In the case of using, as the substrate sheet, a piece of coated paper, art paper or the like, which has a relatively high thermal conductivity, there remains a problem that the sheet is low in sensitivity in receiving an image forming dye.

As a countermeasure against such problems, it is known as described in Patent Document 2 that the following film is used as the substrate of an image receiving layer: a bi-axially drawn film which is made mainly of a thermoplastic resin, such as polyolefin, and has voids or pores. The image receiving layer, in which such a film is used as its substrate has advantages that homogeneous and highly-densed images can be obtained since the sheet has an even thickness, flexibility and a smaller thermal conductivity than paper made of cellulose fiber, and others. However, the use of the film gives disadvantages that the formation of an image receiving layer, and the lamination thereof onto a core member, and other processes are further required so that the production efficiency is insufficient and product costs also increase largely.

Patent Document 3 describes a thermal transfer image receiving member which is used in combination with a dye-supplying material which contains a thermally-transferable dye and which has an image receiving layer for receiving the thermally-transferred dye, in which the image receiving layer is a layer of a film obtained by forming a polyester or resins made mainly of a polyester into a film by melt-extrusion and then drawing the film at a draw ratio by area of 1.2 to 3.6 (inclusive). However, the above-mentioned image receiving layer is insufficient in thermal insulation performance since the layer has no pores or voids. Thus, in the printed matter, to which an image is formed, the printed image density is not at a satisfactory level.

Patent Document 1: Japanese Patent Application Laid-Open No. 2001-030639

Patent Document 2: Japanese Patent Application Laid-Open No. 5-16539

Patent Document 3: Japanese Patent Application Laid-Open No. 9-1943

DISCLOSURE OF THE INVENTION

Problems to be Solved by the Invention

In light of the above-mentioned problems, the invention has been made, and a main object thereof is to: provide a thermal transfer image receiving sheet excellent in releasability even after printing by a thermal transfer process is performed plural times; and to solve a fall in sensitivity in the case of using, as a substrate sheet, a piece of pulp paper such as coated paper, and a fall in productivity, an increase in costs, and other drawbacks in the case of using a laminate-stuck sheet made of void-containing bi-axially drawn sheet and a core member, so as to provide an inexpensive thermal transfer image receiving sheet which has such a high performance that a highly-dense and high-resolution image can be obtained without generating density unevenness or dot omission, and which is good in productivity.

Means for Solving the Problems

To solve the above-mentioned problems, the present invention provides a thermal transfer image receiving sheet, comprising: a substrate sheet; and an image receiving layer which is formed on the substrate sheet and comprising a binder resin, a high molecular weight silicone, and a low molecular weight-modified silicone, characterized in that a kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

According to the invention, the image receiving layer comprises the low molecular weight-modified silicone, which has a kinematic viscosity of 100 $mm^2/s$ to 100000 $mm^2/s$, thereby making it possible to render the image receiving layer a layer excellent in releasability. Moreover, the image receiving layer comprises the high molecular weight silicone, which has a kinematic viscosity of 500000 $mm^2/s$ or more, thereby making it possible to restrain the low molecular weight-modified silicone from bleeding out from the image receiving layer. Thus, a change in the releasability based on image-printing can be restrained. Accordingly, the invention makes it possible to give a thermal transfer image receiving sheet excellent in release stability, with which releasability is not damaged even after printing is made plural times.

In the present invention, the mass ratio of the high molecular weight silicone to the low molecular weight-modified silicone in the image receiving layer (mass of the high molecular weight silicone: mass of the low molecular weight-modified silicone) preferably ranges from 1:4 to 4:1. When the mass ratio between the high molecular weight silicone and the low molecular modified weight silicone in the image receiving layer is in this range, the thermal transfer image receiving sheet of the invention can be made further excellent in releasability and release stability.

The present invention further provides a method for manufacturing a thermal transfer image receiving sheet, comprising: an image receiving layer forming process of melt-extruding an image receiving layer forming resin which comprises a binder resin, a high molecular weight silicone and a low molecular weight-modified silicone, thereby forming an image receiving layer; and a laminating process of laminating the image receiving layer formed in the image receiving layer forming process and a substrate sheet, thereby manufacturing a thermal transfer image receiving sheet, in which the image receiving layer is laminated on the substrate sheet, characterized in that a kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

According to the invention, the image receiving layer forming resin comprises the high molecular weight silicone, which has the kinematic viscosity of 500000 $mm^2/s$ or more, and the low molecular weight-modified silicone, which has the kinematic viscosity of 100 $mm^2/s$ to 100000 $mm^2/s$, thereby making it possible to restrain the low molecular weight-modified silicone from bleeding out when the resin is melt-extruded. It is therefore possible to manufacture a highly-productive thermal transfer image receiving sheet excellent in releasability and release stability.

In the present invention, it is preferable that the image receiving layer forming process is a process of melt-coextruding the image receiving layer forming resin, and a thermal insulation layer forming resin comprising a thermoplastic resin and at least one of an incompatible resin which is incompatible with the thermoplastic resin or a filler, thereby forming an image receiving layer laminate, in which the image receiving layer and a thermal insulation layer are laminated, characterized in that the laminating process is a process of performing the lamination to cause the thermal insulation layer of the image receiving layer laminate and the substrate sheet to be bonded to each other, and further characterized in that the process further comprises a drawing process of drawing the image receiving layer laminate between the image receiving layer forming process and the laminating process. This manufacturing method makes it possible to form easily a thermal transfer image receiving sheet, in which a thermal insulation layer having a desired void ratio (or porosity) is formed.

The present invention still further provides a thermal transfer image receiving sheet having at least a thermal insulation layer and an image receiving layer, characterized in that the sheet is made of a film laminate obtained by: melt-coextruding the thermal insulation layer which comprises a thermoplastic resin and a filler, and the image receiving layer which comprises a thermoplastic resin to form a film; and subsequently subjecting the film to drawing treatment, and further characterized in that an average particle diameter of the filler according to the Coulter Counter method is from 1 μm to 4 μm, and the following particle size distribution is generated: an amount of the filler which is 1 μm or less in size is 15% or less, and an amount of the filler which is 3 μm or more in size is 15% or less.

In the present invention, the thermoplastic resin used in at least one of the thermal insulation layer and the image receiving layer is preferably a polyester resin.

Further, the filler in the thermal insulation layer is preferably made of plurality of silicone resin-fine particles or plurality of silicone resin coated fine particles.

Still further, a side of the thermal insulation layer of the film laminate and the substrate sheet may be melt-extruded and laminated onto each other.

The present invention also provides a thermal transfer image receiving sheet comprising at least an adhesion-improving layer, a thermal insulation layer and an image receiving layer formed in this order, characterized in that the sheet is made of a film laminate obtained by: melt-coextruding the adhesion-improving layer which comprises a thermoplastic resin, the thermal insulation layer which comprises a thermoplastic resin and a filler, and the image receiving layer which comprises a thermoplastic resin to form a film; and subsequently subjecting the film to drawing treatment, and further characterized in that an average particle diameter of the filler according to the Coulter Counter method is from 1 μm to 4 μm, and the following particle size distribution is generated: an amount of the filler which is 1 μm or less in size is 15% or less, and an amount of the filler which is 3 μm or more in size is 15% or less.

In the present invention, the thermoplastic resin used in at least one of the adhesion-improving layer, the thermal insulation layer, and the image receiving layer is preferably a polyester resin.

Further in the invention, a side of the adhesion-improving layer of the film laminate and the substrate sheet may be melt-extruded and laminated onto each other.

In the invention, the above-mentioned image receiving layer preferably comprises an amorphous polyester resin. When the image receiving layer comprises the amorphous polyester resin, the dyeability of the image receiving layer is improved so that the density of a printed image is improved.

In the present invention, the draw ratio by area in the drawing treatment is between 3.6 or more to 25 or less.

The present invention further provides a method for manufacturing a thermal transfer image receiving sheet comprising at least a thermal insulation layer and an image receiving layer, characterized in that: the thermal insulation layer which comprises a thermoplastic resin and a filler, and the image receiving layer which comprises a thermoplastic resin are melt-coextruded to form a film; and the film is subsequently subjected to drawing treatment to form a film laminate; and further characterized in that an average particle diameter of the filler used according to the Coulter Counter method is from 1 μm to 4 μm, and the following particle size distribution is generated: an amount of the filler which is 1 μm or less in size is 15% or less, and an amount of the filler which is 3 μm or more in size is 15% or less.

In the invention, the thermoplastic resin used in at least one of the above-mentioned thermal insulation layer and the above-mentioned image receiving layer is preferably a polyester resin.

The present invention still further provides a method for manufacturing a thermal transfer image receiving sheet, in which the thermal insulation layer and the image receiving layer are formed on a substrate sheet, characterized in that the film laminate mentioned in the above embodiment is formed, and a side of the thermal insulation layer of the laminate and the substrate sheet are subsequently melt-extruded and laminated onto each other.

The invention also provides a method for manufacturing a thermal transfer image receiving sheet comprising at least an adhesion-improving layer, a thermal insulation layer, and an image receiving layer formed in this order, characterized in that the adhesion-improving layer which comprises a thermoplastic resin, the thermal insulation layer which comprises a thermoplastic resin and a filler, and the image receiving layer which comprises a thermoplastic resin are melt-coextruded to form a film; and subsequently the film is subjected to drawing treatment to form a film laminate; and further characterized in that an average particle diameter of the filler used according to the Coulter Counter method is from 1 μm to 4 μm, and the following particle size distribution is generated: an amount of the filler which is 1 μm or less in size is 15% or less, and an amount of the filler which is 3 μm or more in size is 15% or less.

In the invention, the thermoplastic resin used in at least one of the adhesion-improving layer, the thermal insulation layer and the image receiving layer disclosed in the above-mentioned embodiment is a polyester resin.

The present invention provides a method for manufacturing a thermal transfer image receiving sheet, in which the adhesion-improving layer, the thermal insulation layer and the image receiving layer are formed on a substrate sheet in this order, characterized in that the film laminate disclosed in the above-mentioned embodiment is formed, and a side of the adhesion-improving layer of the laminate and the substrate sheet are subsequently melt-extruded and laminated onto each other.

In the invention, the draw ratio by area in the above-mentioned drawing treatment is preferably between 3.6 or more to 25 or less.

Effect of the Invention

The present invention achieves the effect of providing a thermal transfer image receiving sheet excellent in releasability even after printing is performed plural times. Further, the invention achieves the effects of solving a fall in sensitivity in the case of using, as a substrate sheet, a piece of pulp paper such as coated paper, and a fall in productivity, an increase in costs, and other drawbacks in the case of using a laminate-stuck sheet made of void-containing bi-axially drawn sheet and a core member, so as to provide an inexpensive thermal transfer image receiving sheet which has such a high performance that a highly-dense and high-resolution image can be obtained without generating density unevenness or dot omission, and which is good in productivity.

EXPLANATION OF REFERENCES

Figure 1:
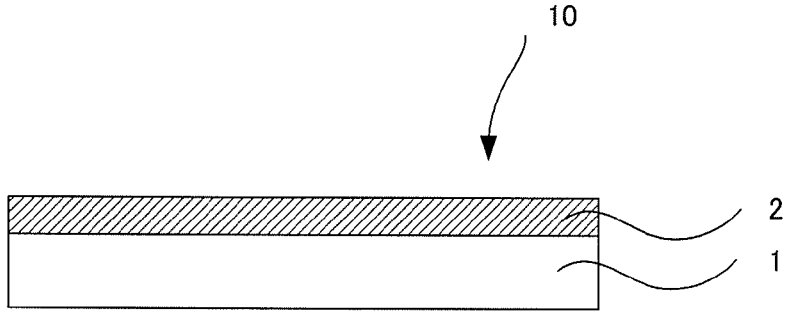
FIG. 1 is a schematic sectional view illustrating an example of the thermal transfer image receiving sheet of the invention.

1 & 1': substrate sheets
2, 2': image receiving layers
3, 3': thermal insulation layers
4, 4': adhesive layers
5: rear face layer
10, 10', and 11: thermal transfer image receiving sheets
21, 21': thermal insulation layer forming resins
22, 22': image receiving layer forming resins

23: die head
24: outlet
31: drawing roll
32: tenter type transversely-drawing machine
41: die head
42: adhesive
43: laminate roll
44: press roll
100: manufacturing apparatus

BEST MODE FOR CARRYING OUT THE INVENTION

The thermal transfer image receiving sheet of the invention, and the method thereof for manufacturing a thermal transfer image receiving sheet will be described hereinafter.

The thermal transfer image receiving sheet of the invention, and the method thereof for manufacturing a thermal transfer image receiving sheet can be classified into two embodiments in accordance with the form thereof.

Hereinafter, the thermal transfer image receiving sheet of the invention, and the method thereof for manufacturing a thermal transfer image receiving sheet will be divided into each of the embodiments, and described.

A. Thermal Transfer Image Receiving Sheet & Method for Manufacturing Thermal Transfer Image Receiving Sheet According to First Embodiment First, a thermal transfer image receiving sheet and a method for manufacturing a thermal transfer image receiving sheet according to a first embodiment of the invention are described.

A-1. Thermal Transfer Image Receiving Sheet According to the First Embodiment First, the thermal transfer image receiving sheet according to the first embodiment will be explained. The thermal transfer image receiving sheet of the present embodiment comprises: a substrate sheet; and an image receiving layer which is formed on the substrate sheet and comprising a binder resin, a high molecular weight silicone, and a low molecular weight-modified silicone, characterized in that a kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

Next, the thermal transfer image receiving sheet according to the present embodiment is described with reference to the drawings. FIG. 1 is a schematic sectional view illustrating an example of the thermal transfer image receiving sheet according to the embodiment. As illustrated in FIG. 1, a thermal transfer image receiving sheet 10 according to the embodiment is composed of a substrate sheet 1 and an image receiving layer 2 formed on the substrate sheet 1. In the thermal transfer image receiving sheet 10 illustrated in FIG. 1, the image receiving layer 2 contains a binder resin, a high molecular weight silicone having a kinematic viscosity of 500000 $mm^2/s$ or more, and a low molecular weight-modified silicone having a kinematic viscosity ranging from 100 $mm^2/s$ to 100000 $mm^2/s$.

Figure 2:
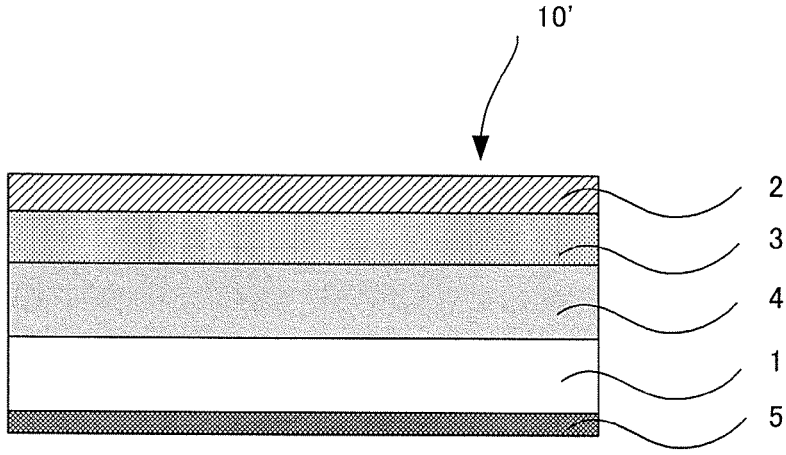
FIG. 2 is a schematic sectional view illustrating another example of the thermal transfer image receiving sheet of the invention.

The thermal transfer image receiving sheet according to the embodiment may have a layer other than the substrate sheet and the image receiving layer. FIG. 2 is a schematic sectional view illustrating another example of the thermal transfer image receiving sheet according to the embodiment. As illustrated in FIG. 2, a thermal transfer image receiving sheet 10' according to the embodiment has a thermal insulation layer 3 and an adhesive layer 4 between a substrate sheet 1 and an image receiving layer 2, and further a rear face layer 5 may be formed on the face of the substrate sheet 1 opposite to the face thereof on which the image receiving layer 2 is formed.

According to the embodiment, the image receiving layer contains the low molecular weight-modified silicone and the high molecular weight silicone, whereby the release stability can be improved. The mechanism that the image receiving layer contains the low molecular weight-modified silicone and the high molecular weight silicone, whereby the release stability can be improved as described above is unclear, but the improvement would be based on the following mechanism.

When the low molecular weight-modified silicone is present on the face of the image receiving layer, the surface energy of the image receiving layer can be lowered; thus, the image receiving layer has a high releasability. However, the silicone bleeds out to the surface of the image receiving layer since the silicon has a low molecular weight. Thus, the silicone has a drawback that when a dye is printed onto the image receiving layer, the silicone is transferred onto a thermal transfer sheet. Accordingly, when the low molecular weight-modified silicone is used alone, there is caused a problem that the releasability of the image receiving layer is lowered by printing an image only one time.

On the other hand, the high molecular weight silicone has a large molecular weight; thus, when a dye is printed onto the image receiving layer, the silicone is less transferred onto the thermal transfer sheet. For this reason, the releasability of the image receiving layer is hardly changed by printing an image one time. However, the high molecular weight silicone has a drawback that the silicone is poorer in the function of lowering the surface energy of the image receiving layer than that of the low molecular weight-modified silicone. Accordingly, when the high molecular weight silicone is used alone, there is caused a problem that a desired releasability cannot be obtained.

The low molecular weight-modified silicone and the high molecular weight silicone are common in that they have Si. Thus, when these are used in a mixture form, the low molecular weight-modified silicone and the high molecular weight silicone interact with each other through Si.

In the embodiment, therefore, the image receiving layer has the low molecular weight-modified silicone and the high molecular weight silicone together, thereby making it possible to prevent the high molecular weight silicone and the low molecular weight-modified silicone from being transferred onto a thermal transfer sheet by the interaction. As a result, an excellent release stability would be able to be expressed.

The reason why the low molecular weight-modified silicone is used as a low molecular weight silicone in the embodiment is that: the silicon has weak compatibility with the image receiving layer resin by the modification, so that the silicone is appropriately restrained from bleeding out when the resin is extruded into a film, when the resin is thermally set after drawn, or when the dye is transferred; therefore, the silicone is present with good balance in the image receiving layer surface, so that a good releasability can be given to the image receiving layer. Furthermore, the use of the low molecular weight-modified silicone can produce the following expectations: when a protective layer is transferred after the formation of an image, the bleeding-out of the silicone, which hinders the adhesiveness to the protective layer, is restrained; and the adhesiveness of the protective layer is improved due to the improving effect in the compatibility with the protective layer by using the organically-modified silicone.

The thermal transfer image receiving sheet according to the embodiment has a substrate sheet and an image receiving layer. Each of the constituents of the thermal transfer image receiving sheet according to the embodiment will be described in detail hereinafter.

1. Image Receiving Layer

First, the image receiving layer used in the embodiment is described. The image receiving layer used in the embodiment is a layer containing a binder resin, a high molecular weight silicone, and a low molecular weight-modified silicone. The layer has a function of receiving a dye transferred from a thermal transfer sheet when the thermal transfer image receiving sheet according to the embodiment is used to form an image.

(1) High Molecular Weight Silicone

The high molecular weight silicone used in the embodiment is described. The high molecular weight silicone used in the embodiment is characterized by having a kinematic viscosity of 500000 $mm^2/s$ or more. The reason why the kinematic viscosity of the high molecular weight silicone is specified as described in the embodiment is that if the kinematic viscosity is less than 500000 $mm^2/s$, the mobility of the high molecular weight silicone in the image receiving layer becomes high so that the function of restraining the low molecular weight-modified silicone, which will be described below, from bleeding out becomes insufficient.

It is sufficient that the kinematic viscosity of the high molecular weight silicone is 500000 $mm^2/s$ or more in the embodiment. The high molecular weight silicone which is in a solid form can also be preferably used. In the embodiment, the kinematic viscosity of the high molecular weight silicone is in particular preferably 10000000 $mm^2/s$ or more. The kinematic viscosity of the high molecular weight silicone in the embodiment means a value measured at a temperature of 25° C. by a viscosity measuring method described in JIS Z8803 unless especially described otherwise. The kinematic viscosity can be measured with, for example, a single cylinder type rotary viscometer TVB33H(U) manufactured by Toki Sangyo Co., Ltd.

The high molecular weight silicone used in the embodiment is not particularly limited as long as the silicone has a polysiloxane structure. The silicone is preferably a silicone having compatibility with the binder resin, which will be described later.

The high molecular weight silicone used in the embodiment may be an unmodified silicone (straight silicone) or a modified silicone. In the embodiment, only one species may be used or two or more species may be used in a mixture form as the high molecular weight silicone.

Examples of the unmodified silicone include dimethylsilicone, methylphenylsilicone, and methylhydrogensilicone.

The modified silicone is not particularly limited as long as the silicone has a polysiloxane structure having an organic functional group. It is preferred to use a silicone having a structure, in which methyl groups of dimethyl silicone are partially substituted (modified) with an organic functional group. Examples of a modified silicone having such a structure include: a side chain type modified silicone, in which organic functional groups are bonded to a part of side chains of a polysiloxane; a both-terminal type modified silicone, in which organic functional groups are bounded to both terminals of a polysiloxane; a single-terminal type modified silicone, in which an organic functional group is bonded to either one terminal of a polysiloxane; a side-chain both-terminal type modified silicone, in which organic functional groups are bonded to a part of side chains of a polysiloxane and both terminals thereof; a side-chain single-terminal type modified silicone, in which organic functional groups are bonded to a part of side chains of a polysiloxane and one out of terminals thereof; and a main chain type modified silicone, in which an organic functional group is bonded to the main chain of a polysiloxane. In the embodiment, anyone of modified silicones having these structures can be preferably used. In particular, the side chain type modified silicone is preferably used.

In the embodiment, modified silicones having the above-mentioned structures may be used alone or may be used in the form of a mixture of two or more thereof.

The organic functional group(s) is/are not particularly limited as long as the group(s) can give a desired releasability to the thermal transfer image receiving sheet according to the embodiment. Such organic groups are roughly classified into reactive functional groups, which have reactivity, and unreactive functional groups, which have no reactivity. In the embodiment, any one of the reactive functional groups and the unreactive functional groups can be preferably used.

Examples of the reactive functional groups used in the embodiment include amino groups, which may be primary amino groups or secondary amino groups, epoxy groups, carboxyl groups, carbinol groups, mercapto groups, and (meth)acrylic groups.

Examples of the unreactive functional groups used in the embodiment include polyether groups, methylstyryl groups, alkyl groups, higher aliphatic acid ester groups, and fluorine-containing functional groups (such as fluoroalkyl groups).

The modified silicone used in the embodiment may be a silicone to which a single organic functional group species is bonded, or a silicone to which two or more organic functional group species are bonded. The silicone to which the two or more species are bonded may be a silicone to which only reactive functional groups are bonded, or a silicone to which a reactive functional group and an unreactive functional group are bonded. In the embodiment, it is preferred to use a modified silicone to which reactive functional groups are bonded, and it is particularly preferred to use a modified silicone to which a reactive functional group and an unreactive functional group are bonded.

As the modified silicone used in the embodiment, there can be used an organic condensed polymer, or a silicone modified polymer, in which an addition polymer (such as polyolefin, polyester, acryl, or ethylene vinyl acetate) is grafted or blocked. The use of such a silicone modified polymer gives an advantage that the compatibility with the binder resin, which will be described later, can be improved.

Specific examples of the high molecular weight silicone used preferably in the embodiment include dimethylsilicone, methylphenylsiclione, acryl-modified silicone, to which a (meth) acrylic group is bonded, polyester modified silicone, and polypropylene modified silicone, to which a polypropylene group is bonded.

The content of the high molecular weight silicone contained in the image receiving layer in the embodiment is not particularly limited as long as the content is in such a range that a desired release stability can be given to the thermal transfer image receiving sheet according to the embodiment. It is advisable to decide the content appropriately in accordance with factors such as the kind of the high molecular weight silicone, the kind of the low molecular weight-modified silicone, and which will be described later. The content of the high molecular weight silicone in the embodiment is preferably from 0.1 to 10 parts by weight, in particular preferably from 0.5 to 3 parts by weight for 100 parts by weight of the binder resin contained in the image receiving layer.

The ratio of the content of the high molecular weight silicone in the image receiving layer to that of the low molecular weight-modified silicone, which will be described later, therein is not particularly limited as long as the ratio is in such a range that desired releasability and release stability can be given to the thermal transfer image receiving sheet according to the embodiment. It is advisable to decide the ratio appropriately in accordance with the factors such as kinds of the high molecular weight silicone and the low molecular weight-modified silicone, and the kind of the binder. In the embodiment, the mass ratio of the high molecular weight silicone to the low molecular weight-modified silicone (the mass of the high molecular weight silicone: the mass of the low molecular weight-modified silicone) in the image receiving layer ranges preferably from 1:4 to 4:1, more preferably from 1:3 to 3:1, in particular preferably from 1:1.

(2) Low Molecular Weight-Modified Silicone

Next, the low molecular weight-modified silicone used in the invention is described. The low molecular weight-modified silicone used in the embodiment is a silicone mainly having a function of lowering the surface energy of the image receiving layer to improve the releasability of the thermal transfer image receiving sheet according to the embodiment, as described above. The silicone is characterized by having a kinematic viscosity of 100 $mm^2/s$ to 100000 $mm^2/s$.

The reason why the kinematic viscosity of the low molecular weight-modified silicone is specified as described above in the embodiment is that: if a silicone which is not organically modified is used and the kinematic viscosity thereof is less than 100 $mm^2/s$, the low molecular weight-modified silicone may bleed out from the image receiving layer in accordance with the kind of the high molecular weight silicone and others when the dye is transferred; and if the kinematic viscosity is 100000 $mm^2/s$ or more, a desired releasability may not be given to the thermal transfer image receiving sheet of the embodiment depending on the kind of the binder resin contained in the image receiving layer, and others.

The kinematic viscosity of the low molecular weight-modified silicone in the embodiment is not particularly limited as long as the viscosity is in the above-mentioned range. The kinematic viscosity is preferably from 300 $mm^2/s$ to 50000 $mm^2/s$, in particular preferably from 1000 $mm^2/s$ to 30000 $mm^2/s$. The kinematic viscosity of the low molecular weight-modified silicone in the embodiment means a value at 25° C. unless especially described otherwise. The measuring method of the kinematic viscosity is equal to that of the kinematic viscosity of the high molecular weight silicone. Thus, description thereof is not repeated herein.

The low molecular weight-modified silicone used in the embodiment is not particularly limited as long as the silicone has a polysiloxane structure having an organic functional group. The structure and the organic functional group of this low molecular weight-modified silicone are equivalent to those described in the above-mentioned item of "(1) High molecular weight silicone". Thus, description thereof is not repeated herein.

About the low molecular weight-modified silicone used in the invention, only one species thereof may be used, or two or more species may be used in a mixture form.

Specific examples of the low molecular weight-modified silicone used in the embodiment include modified silicone, in which a polyether group and an amino group are bonded to each other, polyether modified silicone, and epoxy modified silicone, which are not likely to cause a fall in print sensitivity of the image receiving layer or in the surface property thereof. In the embodiment, out of the above-mentioned modified silicone oils, polyether modified silicone is in particular preferably used. Polyether groups of polyether modified silicone are partially discomposed by heat (180° C. or higher) at the time of the extruding. However, the remaining polyether groups can keep compatibility-balance with the binder resin, which will be described later; therefore, the bleeding-out is appropriately restrained when the image receiving layer resin is extruded into a film, when the resin is thermally set after drawn, or when the dye is transferred, as described above. For this reason, the silicones can be present with good balance in the image receiving layer surface so that a good releasability can be given to the image receiving layer.

The content of the low molecular weight-modified silicone contained in the image receiving layer in the invention is not particularly limited as long as the content is in such a range that a desired releasability can be given to the thermal transfer image receiving sheet of the embodiment. It is advisable to decide the content appropriately in accordance with the kinds of the high molecular weight silicone and the low molecular weight-modified silicone, and others. In the embodiment, the content of the low molecular weight-modified silicone is preferably from 0.1 to 10 parts by weight, in particular preferably from 0.5 to 3 parts by weight for 100 parts by weight of the binder resin contained in the image receiving layer.

(3) Binder Resin

Next, the binder resin used in the image receiving layer is described. The binder resin used in the embodiment is a resin mainly having a function of giving self supporting properties to the image receiving layer in the embodiment.

About the binder resin used in the embodiment, the glass transition temperature thereof is preferably from 50° C. to 100° C., in particular preferably from 70° C. to 85° C.

About the molecular weight of the binder resin used in the embodiment, it is advisable to decide the molecular weight at will in accordance with factors such as various physical properties which are required for the thermal transfer image receiving sheet according to the embodiment, and constituting materials of a thermal transfer sheet used in printing of an image. Usually, the weight-average molecular weight (Mw) is preferably 11000 or more, in particular preferably 15000 or more. If the weight-average molecular weight of the binder resin is lower than the range, the elasticity or the heat resistance of the image receiving layer lowers so that it may become difficult to keep releasability between a thermal transfer sheet and the thermal transfer image receiving sheet of the embodiment. Moreover, if the weight-average molecular weight is more than the range, the adhesiveness to the substrate sheet, which will be described later, may deteriorate. The weight-average molecular weight in the embodiment can be obtained by, for example, the GPC method.

Specific examples of the binder resin used in the embodiment include polyolefin resins such as polypropylene; halogenated polymers such as polyvinyl chloride, vinylchloride/vinyl acetate copolymer, and polyvinylidene chloride; vinyl polymers such as polyvinyl acetate, ethylene/vinyl acetate copolymer, and polyacrylic ester; polyester resins such as polyethylene terephthalate, and polybutylene terephthalate; polystyrene resins; polyamide resins; copolymer resins each made from an olefin such as ethylene or propylene, and a different vinyl monomer; ionomers; cellulose resins such as cellulose diacetate; polycarbonate resins; phenoxy resins; epoxy resins; polyvinyl acetal resins; and polyvinyl alcohol resins. Other examples thereof include hydrogenated petroleum resins, aliphatic hydrocarbon resins, alicyclic hydrocarbon resins, aromatic hydrocarbon resins, rosin resins, terpene resins, and coumarone-indene resins, which are each known as a tackifying resin or a resin modifier.

In the embodiment, as the binder resin, one resin species may be used, or two or more resin species may be used in a mixture form.

In the embodiment, a polyester resin is preferably used as the binder resin. An amorphous polyester resin is most preferably used since the dyeability thereof is high.

The amorphous polyester resin is not particularly limited as long as the resin is substantially amorphous. An example of the amorphous polyester resin used in the embodiment is a polyester resin containing, as main components, terephthalic acid and ethylene glycol and containing, as one or more copolymerizable components, a different acid component and/or a different glycol component.

Examples of the acid component include aliphatic dibasic acids (such as adipic acid, sebacic acid, and azelaic acid), and aromatic dibasic acids (such as isophthalic acid, diphenyldicarboxylic acid, 5-tert-butylisophthalic acid, 2,2,6,6-tetramethylbiphenyl-4,4-dicarboxylic acid, 2,6-naphthalenedicarboxylic acid, 1,1,3-trimethyl-3-phenylindene-4,5-dicarboxylic acid.

Examples of the glycol component include aliphatic diols (such as neopentyl glycol, diethylene glycol, propylene glycol, butanediol, and hexanediol), alicyclic diols (such as 1,4-cyclohexanedimethanol), and aromatic diols (such as xylylene glycol, bis(4-β-hydroxyphenyl)sulfone, and 2,2-(4-hydroxyphenyl)propane derivatives).

As the binder resin used in the embodiment, a resin, in which a polymer (resin) having an epoxy group or carbodiimide group is added to the above-mentioned amorphous polyester resin can be used. Such a binder resin has advantages of: making it possible to improve the extrusion workability at high temperatures and the heat resistance of the image receiving layer since the above-mentioned epoxy-group- or carbodiimide-group-containing polymer cross-linking reacts with the polyester resin; and making it possible to improve the releasability of a high image-printing energy area when an image is printed.

The above-mentioned epoxy-group-having polymer is made of, for example, an ester made from methacrylic acid or acrylic acid and one or more out of various glycidyl alcohols, and examples thereof include methylglycidyl ester, butylglycidyl ester, polyethylene glycol diglycidyl ester, polypropylene glycol diglycidyl ester, and neopentyl glycol diglycidyl ester.

As the above-mentioned carbodiimide-group-having polymer, for example, a CARBODILITE® (HMV-8CA) manufactured by Nisshinbo Industries, Inc. can be used.

(4) Other Compounds

The image receiving layer in the embodiment may contain compounds other than the binder resin, the high molecular weight silicone, and the low molecular weight-modified silicone. The other compounds used in the image receiving layer will be described hereinafter.

(Wax)

A wax may be incorporated into the image receiving layer in the embodiment in order to improve the thermal sensitivity, the thermal transportability and the abrasion resistance. The improvement can be attained by adding, as such a wax, for example, a synthetic wax such as a wax-form aliphatic acid amide, any one of various lubricants or a paraffin wax, or a natural wax such as candelilla wax or carnauba wax, an oil such as silicone oil or perfluoroalkyl ether. Besides, the following can also be used: a polyethylene resin, a phosphate ester, a resin such as a silicone resin, a tetrafluoroethylene resin or a fluoroalkyl ether resin, and an inorganic lubricant such as silicon carbide or silica.

(Curing Agent)

A curing agent may be added to the image receiving layer in the embodiment. The curing agent is used to react with active hydrogen in the image receiving layer to crosslink and cure the image receiving layer. The use of the curing agent makes it possible to give heat resistance to the image receiving layer.

The curing agent used in the embodiment is not particularly limited as long as the curing agent can give a desired heat resistance to the image receiving layer. Usually, an isocyanate, a chelate compound or the like is used. In particular, an isocyanate compound of a non-yellowing type is preferably used. Specific examples thereof include xylylenediisocyanate (XDI), hydrogenated XDI, isophorone diisocyanate (IPDI), hexamethylenediisocyanate (HDI), and adduct bodies/buret bodies, oligomers, and prepolymers thereof.

In the embodiment, a catalyst may be added thereto as a reaction aid for the above-mentioned isocyanate compound. In this case, a known catalyst can also be used as the reaction aid used in the embodiment. A typical example of the catalyst is di-n-butyltin dilaurate (DBTDL), which is a tin based catalyst. Besides, effective is an aliphatic acid dibutyltin salt based catalyst, an aliphatic acid monobutyltin salt based catalyst, an aliphatic acid monooctyltin salt based catalyst, or a dimer thereof. As the amount of tin per weight is larger, the reaction rate becomes larger; thus, in accordance with the used isocyanate compound(s), the kind thereof, a combination therefrom, and the addition amount should be selected. In the case of using a block type isocyanate compound, it is also effective to use a block dissociated catalyst together.

(UV Absorbent and Light Stabilizer)

A UV agent and a light stabilizer may be used in the image receiving layer in the embodiment. The UV absorbent and the light stabilizer which can be used in the embodiment are not particularly limited as long as they have a function of improving the light resistance of a thermal transfer printed matter formed by use of the thermal transfer image receiving sheet of the embodiment. The UV absorbent and the light stabilizer used in the embodiment may be compounds described in Japanese Patent Application Laid-Open Nos. 59-158287, 63-74686, 63-145089, 59-196292, 62-229594, 63-122596, 61-283595, and 1-204788, and compounds each known as a substance for improving the image durability of a photograph or any other image forming material.

(Filler)

A filler may be incorporated into the image receiving layer in the embodiment. The filler which can be used in the embodiment is not particularly limited as long as the filler has a function of improving the lubricity of a thermal transfer sheet by the inclusion thereof into the image receiving layer, and making it possible to give desired high-speed printing properties to the thermal transfer image receiving sheet of the embodiment. In the embodiment, general inorganic fine particles or organic resin particles can be used as such a filler.

Examples of the inorganic fine particles include silica gel, calcium carbonate, titanium oxide, acid clay, activated clay, and alumina. Examples of the organic fine particles include fluorine-contained resin particles, guanamine resin particles, acrylic resin particles, and silicone resin particles, and other resin particles. The content of the filler can be decided at will in accordance with the specific gravity of the filler, and others.

(Pigment)

A pigment which can be used in the embodiment is not particularly limited as long as the pigment has a function of improving the quality of an image formed by means of the thermal transfer image receiving sheet of the embodiment by the inclusion thereof into the image receiving layer. Examples of the pigment which can be used in the embodiment include titanium white, calcium carbonate, zinc oxide, barium sulfate, silica, talc, clay, kaolin, activated clay, and acid clay. The addition amount of such a pigment can be used at will as long as the objects of the embodiment are not damaged.

(Plasticizer)

A plasticizer which can be used in the embodiment is not particularly limited as long as the plasticizer has a function of improving the diffusibility of the dye in the image receiving layer by the inclusion thereof into the image receiving layer. Examples of the plasticizer which can be used in the embodiment include phthalic acid esters, trimellitic acid esters, adipic acid esters, other saturated or unsaturated carboxylic acid esters, citric acid esters, epoxidized soybean oil, epoxidized linseed oil, epoxystearic acid epoxy compounds, orthophosphoric esters, phosphorus esters, and glycol esters. The content of the plasticizer can be decided at will in accordance with the kind of the plasticizer and others as long as the objects of the embodiment are not damaged.

(Releasing Agent)

The image receiving layer in the embodiment may contain a releasing agent other than the high molecular weight silicone and the low molecular weight-modified silicone. As the releasing agent used in the embodiment, there can be used, for example, a phosphate ester compound, a fluorine-contained compound, and a releasing agent known in the present technical field.

(5) Image Receiving Layer

The image receiving layer in the embodiment may be made into a monolayer, or may be optionally made into two or more layers. When the image receiving layer is made into plural layers, layers equal to each other in composition or the like may be laminated onto each other, or layers different from each other in composition may be laminated onto each other.

The thickness of the image receiving layer in the embodiment can be decided at will in accordance with the usage of the thermal transfer image receiving sheet according to the embodiment, and others. Usually, the thickness is preferably from 0.5 μm to 50 μm, in particular preferably from 1 μm to 20 μm. If the thickness of the image receiving layer is smaller than the range, the mechanical strength of the image receiving layer is low so that the image receiving layer may be "cracked" or "torn". If the thickness is larger than the range, it may become difficult that an image receiving layer excellent in flatness is formed.

When the image receiving layer is composed of two or more laminated layers, the above-mentioned thickness range corresponds to the total thickness.

2. Substrate Sheet

Next, the substrate sheet used in the embodiment is described. The substrate sheet used in the embodiment is a sheet having a function of supporting the image receiving layer formed on the substrate sheet and expressing self supporting properties of the thermal transfer image receiving sheet according to the embodiment.

The substrate sheet used in the embodiment is not particularly limited as long as the sheet has desired self supporting properties, mechanical strength and others in accordance with the usage of the thermal transfer image receiving sheet of the embodiment, and others. Such a substrate sheet may be, for example, a condenser paper, a glassine paper, a parchment paper, a paper having a high sizing degree, a (polyolefin type or polystyrene type) synthetic paper, a fine quality paper, an art paper, a coated paper, a cast coated paper, a wallpaper, a lining paper, a synthetic resin or emulsion impregnated paper, a synthetic rubber latex impregnated paper, a synthetic resin internally-added paper, a paperboard, a cellulose fiber paper, or a film made of polyester, polyacrylate, polycarbonate, polyurethane, polyimide, polyetherimide, a cellulose derivative, polyethylene, ethylene/vinyl acetate copolymer, polypropylene, polystyrene, acrylic polymer, polyvinyl chloride, polyvinylidene chloride, polyvinyl alcohol, polyvinyl butyral, nylon, polyetheretherketone, polysulfone, polyethersulfone, tetrafluoroethylene/perfluoroalkyl vinyl ether, polyvinyl fluoride, tetrafluoroethylene/ethylene, tetrafluoroethylene/hexafluoropropylene, polychlorotrifluoroethylene, polyvinylidene fluoride, or the like.

As the substrate sheet used in the embodiment, there can also be used a white opaque film obtained by adding a white pigment or filler to any one of these synthesized resins and then making the resultant into a film, or a foamed sheet, in which any one of these resins is foamed.

Furthermore, the substrate sheet used in the embodiment may be a laminate made of any combination from the above-mentioned substrate sheets.

In the embodiment, it is particularly preferred to use, out of the above-mentioned substrate sheets, a pulp paper such as a fine quality paper, art paper, coated paper or cast coated paper. The use of such a pulp paper makes it possible to decrease costs or attain some other advantage.

The thickness of the substrate sheet used in the embodiment is usually from about 10 μm to 300 μm.

When the adhesiveness between the substrate sheet and a layer formed thereon is poor, it is preferred to subject the surface of the substrate sheet to various primer treatments or corona discharge treatment.

3. Thermal Transfer Image Receiving Sheet

The thermal transfer image receiving sheet of the embodiment may have a constituent different from the image receiving layer and the substrate sheet. Such a different constituent is not particularly limited as long as the constituent can give a desired function to the thermal transfer image receiving sheet of the embodiment. Examples of the different constituent which can be used in the embodiment will be described in turn.

(1) Thermal Insulation Layer

A thermal insulation layer used in the embodiment is a layer which is usually formed between the substrate sheet and the image receiving layer and has such heat insulating properties that when heat is applied to the image receiving layer, the substrate sheet and so on are prevented from being thermally damaged. The thermal insulation layer also has a function of giving cushion properties to the thermal transfer image receiving sheet of the embodiment to improve the image-printing performance thereof. The thermal insulation layer used in the embodiment usually contains a thermoplastic resin, and at least one of an incompatible resin which is incompatible with the thermoplastic resin or a filler.

Examples of the thermoplastic resin used in the thermal insulation layer include polyolefin resins such as polypropylene, halogenated polymers such as polyvinyl chloride and polyvinylidene chloride, vinyl resins such as polyvinyl acetate, ethylene vinyl acetate copolymer, vinyl chloride vinyl acetate copolymer and polyacrylic ester, acetal resins such as polyvinyl formal, polyvinyl butyral and polyvinyl acetal, various saturated or unsaturated polyester resins, polycarbonate resins, cellulose resins such as cellulose acetate, styrene based resins such as polystyrene, acryl/styrene copolymer, acrylonitrile/styrene copolymer, urea resins, melamine resins, and polyamide resins such as benzoguanamine resin. A blend of any two or more out of these resins can be used as long as the extrusion workability is kept and the two or more are compatible with each other.

In the embodiment, it is particularly preferred to use, as the above-mentioned thermoplastic resin, a polyester resin. The polyester resin is excellent in drawing suitability and also has an advantage about costs.

The polyester resin is, for example, a polyester resin obtained by polycondensing an aromatic dicarboxylic acid such as terephthalic acid, isophthalic acid or naphthalene dicarboxylic acid, or an ester thereof, and a glycol such as ethylene glycol, diethylene glycol, 1,4-butanediol or neopentyl glycol. Typical examples of this polyester include polyethylene terephthalate resin, polybutylene terephthalate resin, polyethylene/butylene terephthalate, and polyethylene-2,6-naphthalate. These polyester resins may each be a homopolymer or a copolymer, in which a third component is also copolymerized. The copolymer has an advantage that the drawing suitability is improved and the drawn ratio can be made high.

The incompatible resin used in the thermal insulation layer is not particularly limited as long as the resin is incompatible with the thermoplastic resin, is uniformly incorporated and dispersed into the thermoplastic resin, and exfoliates in the interface with the thermoplastic resin at the time of drawing the resins for the thermal insulation layer, so as to become sources for generating voids.

An example of the incompatible resin in the case of using, as the thermoplastic resin, the above-mentioned polyester resin is not particularly limited as long as the incompatible resin is incompatible with the polyester resin, is uniformly incorporated and dispersed into the polyester resin, and exfoliates in the interface with the polyester resin at the time of drawing the resins for the thermal insulation layer, so as to become sources for generating voids. Examples of such an incompatible resin include polystyrene resins, polyolefin resins, polyacrylic resins, polycarbonate resins, polysulfone resins, and cellulose resins. In the thermal insulation layer, these may be used alone or may be optionally used in the form of a composite of two or more thereof. Alternatively, when these resins are copolymerized, an appropriate affinity with the polyester resin can be given thereto.

In the embodiment, it is preferred to use, out of the above-mentioned resins, polystyrene resins, or polyolefin resins such as polymethylpentene, polypropylene or cyclic olefins.

When the thermal insulation layer is constructed to be made mainly of the thermoplastic resin and the incompatible resin, the ratio between the thermoplastic resin, which insulates heat, and the incompatible resin in the thermal insulation layer is as follows: the content by percentage of the incompatible resin in the total amount of the resin composition of the thermal insulation layer is preferably from 3 to 40% by mass, in particular preferably from 5 to 30% by mass. If the content by percentage of the incompatible resin is smaller than the range, a desired void ratio cannot be given to the thermal insulation layer so that the heat resistance, the cushion properties and other properties thereof may become insufficient. If the content is larger than the range, the heat resistance and the mechanical strength may lower.

The thermal insulation layer used in the embodiment may be made mainly of the above-mentioned thermoplastic resin and a filler. The filler used in this case is not particularly limited as long as the filler is incompatible with the thermoplastic resin, is uniformly incorporated and dispersed into the thermoplastic resin, and exfoliates in the interface with the thermoplastic resin at the time of drawing the resins for the thermal insulation layer, so as to become sources for generating voids.

As the filler used in the embodiment, for example, the following can be used: inorganic fillers such as silica, kaolin, talc, calcium carbonate, zeolite, alumina, barium sulfate, carbon black, zinc oxide, and titanium oxide; and organic fillers such as a crosslinking polymer and an organic white pigment. The size of these fillers is set to have an average particle diameter of about 0.5 μm to 3 μm when they are used. A silicone filler is particularly preferred from the viewpoint of easiness in generating of the interface exfoliation, sharpness of the particle size distribution, and others.

The thermal insulation layer used in the embodiment may contain an antistatic agent, an ultraviolet absorbent, a plasticizer, a dispersing agent, a colorant, a compatibility accelerator, and so on as components other than the above-mentioned thermoplastic resin, incompatible resin and filler.

The dispersing agent has an effect of making the dispersion diameter of the incompatible resin fine or attaining uniform dispersion of the filler, so as to make it possible to make formed voids fine. Thus, the whiteness or the formability of the film can be improved. The dispersing agent, which exhibits the above-mentioned effect, may be more preferably an olefin polymer or copolymer having a polar group, such as a carboxyl group or epoxy group, or a functional group reactive with the polyester; diethylene glycol; polyalkylene glycol; or a surfactant. These may be used alone or in combination of two or more thereof.

The examples of the compatibility accelerator may be a block copolymer; a graft copolymer; a polymer having, at its terminal or side chain, a functional group; or a high molecular weight macromer, which has a polymerizable group at a terminal of a polymer.

The void ratio of the thermal insulation layer used in the embodiment is not particularly limited as long as the ratio makes it possible to realize desired heat insulating properties, cushion properties and other properties. It is advisable to decide the ratio at will in accordance with the material which constitutes the thermal insulation layer, and others. The ratio is preferably from 15% to 65%. If the void ratio is smaller than the range, the ratio of pores which are finely porous micro-voids is small so that the features of the thermal insulation layer in the embodiment, such as satisfactory heat insulating properties and cushion properties, may not be exhibited. If the void ratio of the thermal insulation layer is larger than the range, a coated film remaining on the thermal insulation layer becomes thin or the finely voids or pores crumble so that micro-voids may not be formed.

The void ratio (V) is calculated out, on the basis of the percentage obtained by dividing the density ($\rho$) of the thermal insulation layer which is the target by the density ($\rho_0$) of the whole of the resin, the filler, and other solid components which constitute the thermal insulation layer, using the following equation: void ratio $(V)=(1-\rho/\rho_0)\times 100$ (%). The density ($\rho$) of the thermal insulation layer is the density of the thermal insulation layer having a foamed structure and is a numerical value about the structure, which contains voids. On the other hand, the density ($\rho_0$) of the whole of the resin, the filler, and the other solid components which constitute the thermal insulation layer is the density of the solids alone which contain no voids. About the void ratio of the thermal insulation layer, the density ($\rho$) of the foamed-structure-having thermal insulation layer used in the embodiment is preferably from 0.3 g/cm$^3$ to 1.0 g/cm$^3$.

The thickness of the thermal insulation layer used in the embodiment is not particularly limited as long as the thickness makes it possible to express desired heat insulating properties, cushion properties and other properties in accordance with the materials which constitute the thermal insulation layer, and others. Usually, the thickness is set into the range of about 10 μm to 100 μm. If the thickness of the thermal insulation layer is smaller than the range, desired heat insulating properties, cushion properties and other properties may not be expressed. If the thickness is larger than the range, the heat resistance and the mechanical strength may lower.

(2) Adhesive Layer

In the thermal transfer image receiving sheet according to the embodiment, an adhesive layer having adhesiveness to the image receiving layer and the substrate sheet may be formed between the two. The formation of such an adhesive layer gives an advantage that it becomes easy to laminate the substrate sheet and the image receiving layer.

The adhesive which constitutes the adhesive layer is not particularly limited as long as the adhesive exhibits adhesiveness to layers adjacent to the adhesive layer. It is preferred to use a resin, in which necking-in (a phenomenon that the width of a film becomes narrower than the die width, or the degree thereof) is less caused or is smaller and the drawing-down properties, index of the high-speed spreadability and high-speed workability, are relatively good. Examples of such an adhesive include polyolefin resins such as high density polyethylene, middle density polyethylene, low density polyethylene, polypropylene, ethylene/vinyl acetate copolymer, ethylene/acrylic acid copolymer (EAA), ethylene/methacrylic acid copolymer (EMAA), ethylene/maleic acid copolymer, ethylene/fumaric acid copolymer, ethylene/maleic anhydride copolymer, ethylene/methyl acrylate copolymer, and ethylene/methyl methacrylate copolymer; polyester resins such as polyethylene terephthalate; ionomer resins; nylons; polystyrene; and polyurethane.

As the adhesive, an acrylic resin can also be used. The acrylic resin which can be used as the adhesive may be an acrylamide made mainly of acrylic acid (and/or methacrylic acid) and a derivative thereof, an acrylic resin obtained by polymerizing acrylonitrile, any other acrylic acid ester, a copolymer resin, in which a different monomer such as styrene is copolymerized, or the like. Specific examples of such an acrylic resin include homopolymers or copolymers each containing a ester(meth)acrylate, such as polymethyl (meth) acrylate, polyethyl (meth)acrylate, polybutyl (meth)acrylate, methyl (meth)acrylate/butyl (meth)acrylate copolymer, methyl (meth)acrylate/2-hydroxyethyl (meth)acrylate copolymer, butyl (meth)acrylate/2-hydroxyethyl (meth)acrylate copolymer, methyl (meth)acrylate/2-hydroxypropyl (meth)acrylate copolymer, methyl (meth)acrylate/butyl (meth)acrylate/2-hydroxyethyl (meth)acrylate copolymer, and styrene/methyl (meth)acrylate copolymer. The wording "(meth)acrylate" herein is used as a wording having a meaning of acrylate and methacrylate.

The adhesive described above may be made of one resin species or may be a mixture of plural resin species.

(3) Rear Face Layer

If necessary, a rear face layer may be formed in the thermal transfer image receiving sheet used in the embodiment. The function of such a rear face layer is not particularly limited, and a layer having a desired function can be formed in accordance with the usage of the thermal transfer image receiving sheet of the embodiment, and others.

In the embodiment, it is preferred to form, as the above-mentioned rear face layer, a rear face layer having a function of improving the transportability of the thermal transfer image receiving sheet or a function of preventing the sheet from curling. The constituting material of the rear face layer having such a function is not particularly limited as long as the material is a material capable of giving a desired transportability or curl preventing performance to the rear face layer. Usually, the following is used: a product, in which a filler is added as an additive to a resin such as acrylic resin, cellulose resin, polycarbonate resin, polyvinyl acetal resin, polyvinyl alcohol resin, polyamide resin, polystyrene resin, polyester resin, or halogenated polymer.

Preferably, the rear face layer is formed by curing the above-mentioned resin with a curing agent. Such a curing agent is not particularly limited as long as the agent makes it possible to cure the resin. A generally known resin may be used. In particular, an isocyanate compound is preferred since the rear face layer resin reacts with the isocyanate compound or the like to form a urethane bond, so that the resin is cured and made into a three-dimensionally form, thereby improving the heat resistance storability and the solvent resistance and further making the adhesiveness to the substrate sheet good.

The addition amount of the curing agent is not particularly limited as long as the amount is in such a range that a desired hardness can be given to the rear face layer. Usually, the amount is preferably from 1 to 2 for one reactive group equivalent of the resin. If the amount is less than 1, much time is required until the curing of the resin is finished and further the heat resistance or the solvent resistance may deteriorate. If the amount is more than 2, after the formation of the resin into a film the film changes with time or there may be caused an inconvenience that the lifespan of a coating solution for the rear face layer is short.

The filler is not particularly limited as long as the filler can give a desired lubricity to the rear face layer. As such a filler, there can be used an organic filler such as an acrylic filler, a polyamide filler, a fluorine-contained filler or polyethylene wax, or an inorganic filler such as silicon dioxide or a metal oxide. In the embodiment, a polyamide filler is preferred out of the above-mentioned organic and inorganic fillers. The polyamide filler has a high melting point and thermal stability, and is good in oil resistance, chemical resistance and others so as not to be easily dyed with a dye.

As such a polyamide filler, a filler in a spherical form is used. It is advisable to adjust the average particle diameter in accordance with the addition amount of the filler, which will be described later, and other factors. Usually, the average particle diameter is preferably from 0.01 μm to 30 μm, in particular preferably from 0.01 μm to 10 μm. If the average particle diameter is smaller than the range, the filler hides into the rear face layer so that the function of a sufficient lubricity is not expressed with ease. If the average particle diameter is larger than the range, the filler projects largely from the rear face layer so that the frictional coefficient may be made high or the filler may fall away. As the polyamide filler, a mixture of two or more polyamide fillers having different average particle diameters can also be used.

As the constituting material of the polyamide filler, a nylon resin is preferably used. Examples of the nylon resin include nylon 6, nylon 66, and nylon 12. In the embodiment, nylon 12 is preferably used. The nylon 12 filler is so good in water resistance that a change in the characteristics thereof based on water absorption is relatively small.

It is advisable to adjust the content by percentage of the filler in the rear face layer appropriately in such a range that a desired transportability can be obtained in accordance with the constituting material of the used filler, the average particle diameter and other factors. Usually, the content by percentage is preferably from 0.01 to 200% by mass, in particular preferably from 1 to 100% by mass, especially preferably from 0.05 to 2% by mass of the above-mentioned resin which constitutes the rear face layer. If the content is smaller than the range, the lubricity becomes insufficient so that inconveniences such as a paper jam may be caused when a paper sheet is supplied to a printer. If the content is larger than the range, the thermal transfer image receiving sheet slips excessively so that a color mismatch or some other defect may be generated in a printed image.

The method of forming the rear face layer is not particularly limited as long as the method is a method capable of making the formed rear face layer very good in flatness. An ordinary method can be used. Such a method is, for example, a method of coating a coating solution for forming the rear face layer containing the above-mentioned resin and filler onto the above-mentioned core member and then drying the solution to form a film.

(4) Others

If necessary, the thermal transfer image receiving sheet according to the embodiment may have a constituent other than the above. The constituent other than the above is, for example, an antistatic layer.

4. Method for Manufacturing the Thermal Transfer Image Receiving Sheet

The method for manufacturing the thermal transfer image receiving sheet according to the embodiment is not particularly limited as long as the method makes it possible to manufacture the thermal transfer image receiving sheet, which has the above-mentioned structure. The sheet can be manufactured by, for example, a method described in the item of "B. Method for manufacturing a thermal transfer image receiving sheet", which will be described later.

A-2. Method for Manufacturing a Thermal Transfer Image Receiving Sheet According to the First Embodiment Next, the method for manufacturing a thermal transfer image receiving sheet according to the first embodiment will be explained. The method for manufacturing a thermal transfer image receiving sheet of the present embodiment comprises: an image receiving layer forming process of melt-extruding an image receiving layer forming resin which comprises a binder resin, a high molecular weight silicone and a low molecular weight-modified silicone, thereby forming an image receiving layer; and a laminating process of laminating the image receiving layer formed in the image receiving layer forming process and a substrate sheet, thereby manufacturing a thermal transfer image receiving sheet, in which the image receiving layer is laminated on the substrate sheet, characterized in that a kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

In the method for manufacturing a thermal transfer image receiving sheet of the embodiment, it is preferred that: the image receiving layer forming process is a process of melt-coextruding an image receiving layer forming resin, and a thermal insulation layer forming resin comprising a thermoplastic resin and at least one of an incompatible resin which is incompatible with the thermoplastic resin or a filler, thereby forming an image receiving layer laminate, in which an image receiving layer and a thermal insulation layer are laminated; the laminating process is a process of performing the lamination to cause the thermal insulation layer of the image receiving layer laminate and a substrate sheet to be bonded to each other; and the process further comprises a drawing process of drawing the image receiving layer laminate between the image receiving layer forming process and the laminating process.

Figure 3:
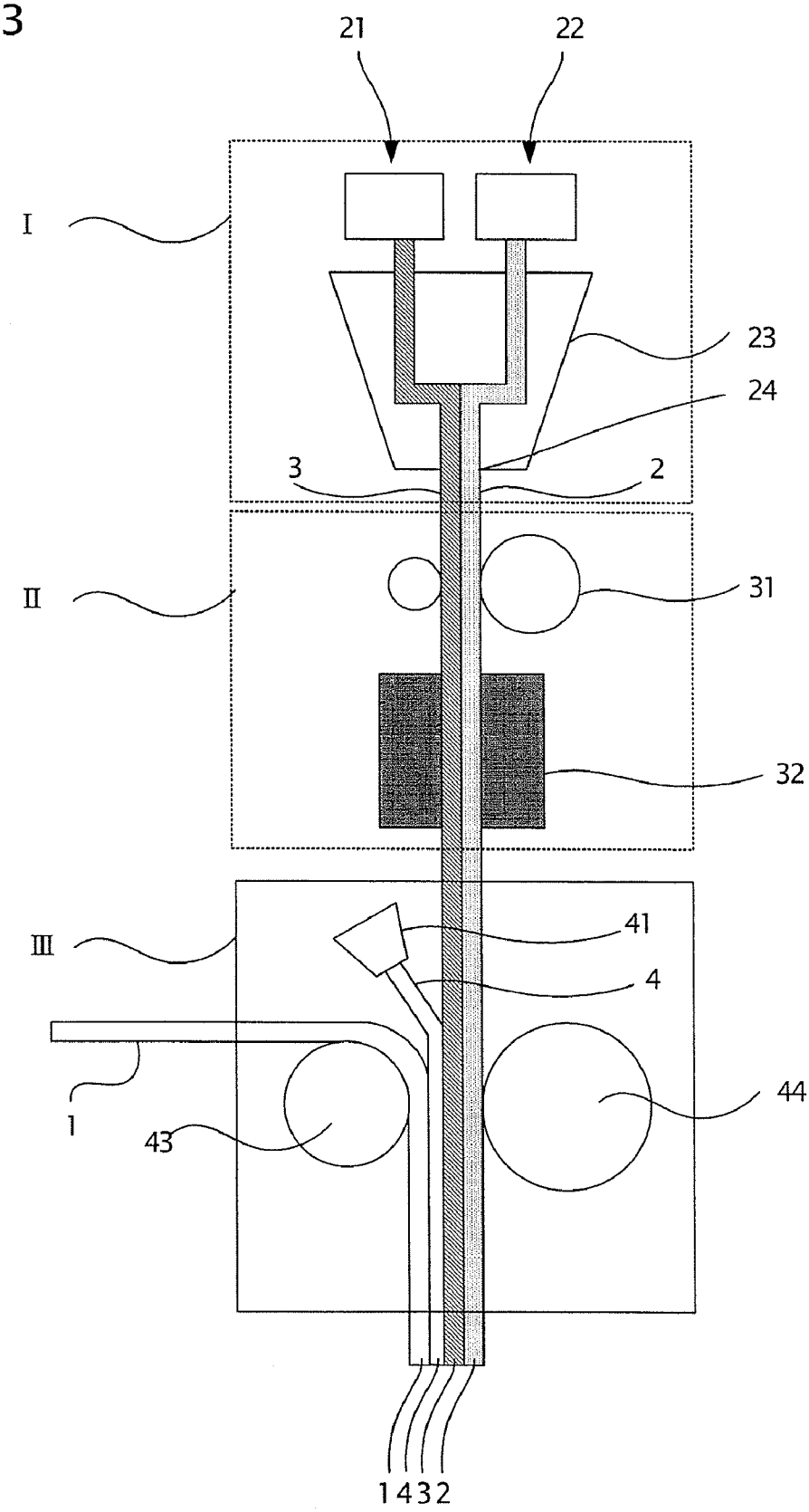
FIG. 3 is a schematic view illustrating an example of the method of the invention for manufacturing a thermal transfer image receiving sheet.

Next, the method for manufacturing a thermal transfer image receiving sheet according to the embodiment is described with reference to the drawings. FIG. 3 is a schematic view illustrating an example of the thermal transfer image receiving sheet manufacturing method according to the embodiment. As illustrated in FIG. 3, the thermal transfer image receiving sheet manufacturing method according to the embodiment has: an image receiving layer forming process I of supplying a thermal insulation layer forming resin 21 and an image receiving layer forming resin 22, through different paths, to a die head 23, and then co-extruding the thermal insulation layer forming resin 21 and the image receiving layer forming resin 22, in a state that they are melted, from an outlet 24 in the die head 23, thereby forming a film of an image receiving layer laminate composed of two layers of an image receiving layer 2 and a thermal insulation layer 3;

a drawing process II of causing drawing rolls 31 to have peripheral velocities different from each other and using the rolls 31 to draw longitudinally the image receiving layer laminate formed in the image receiving layer forming process I, then using a tenter type transversely-drawing machine 32 to subject the resultant film to transversely drawing treatment, and subsequently heating the film up to such a degree that the material thereof is crystallized while the film is chucked with the tenter, thereby heat-setting the film; and a laminating process III of melt-extruding an adhesive 42 from a die head 41 so as to pass a substrate sheet 1 and the image receiving layer laminate, with the adhesive 42 interposed therebetween, between a laminate roll 43 and a press roll 44 and press the resultant by means of the two rolls, so as to attain EC laminating;

thereby manufacturing a thermal transfer image receiving sheet 12, in which the adhesive layer 4, the thermal insulation layer 3 and the image receiving layer 2 are formed in this order on the substrate sheet 1, the image receiving layer forming resin containing a high molecular weight silicone having a kinematic viscosity of 500000 $mm^2/s$ or more and a low molecular weight-modified silicone having a kinematic viscosity of 100 $mm^2/s$ to 100000 $mm^2/s$.

In accordance with the thermal transfer image receiving sheet manufacturing method according to the embodiment, the image receiving layer forming resin contains the high molecular weight silicone, which has a kinematic viscosity of 500000 $mm^2/s$ or more, and the low molecular weight-modified silicone, which has a kinematic viscosity of 100 $mm^2/s$ to 100000 $mm^2/s$, thereby making it possible to restrain the low molecular weight-modified silicone from bleeding out at the time of the melt-extrusion. It is therefore possible to manufacture a thermal transfer image receiving sheet high in productivity and excellent in releasability and release stability.

The thermal transfer image receiving sheet manufacturing method according to the embodiment has the image receiving layer forming process and the laminating process. Each of these processes will be described in detail hereinafter.

1. Image Receiving Layer Forming Process

First, the image receiving layer forming process in the embodiment is described. The image receiving layer forming process in the embodiment is a process of melt-extruding an image receiving layer forming resin comprising a binder resin, a high molecular weight silicone and a low molecular weight-modified silicone, thereby forming an image receiving layer, characterized in that the kinematic viscosity of the high molecular weight silicone is 500000 $mm^2/s$ or more and the kinematic viscosity of the low molecular weight-modified silicone is from 100 $mm^2/s$ to 100000 $mm^2/s$.

The image receiving layer formed in the present process may be a single layer or an image receiving layer laminate, in which the image receiving layer and a different layer are laminated. In the embodiment, it is preferred that the image receiving layer is formed as the image receiving layer laminate, and it is particularly preferred that the image receiving layer is formed as the image receiving layer laminate, in which the image receiving layer and a thermal insulation layer are laminated.

The method of forming the image receiving layer in the process is not particularly limited as long as the method makes it possible to make the thickness of the formed image receiving layer even. An ordinary method may be used. Examples of such a method may be a T die method or an inflation method. When the image receiving layer laminate is formed into a film in the process, the following may be used as the method of forming the film: a field block method, a multi-manifold method, a co-extrusion using a T die such as a multi-slot die method, or a co-extrusion method based on an inflation manner using a round die.

The image receiving layer forming resin used in the process is a resin containing a binder resin, a high molecular weight silicone and a low molecular weight silicone. The binder resin, the high molecular weight silicone and the low molecular weight silicone used in the process are equivalent to those described in the above-mentioned item of "A. Thermal transfer image receiving sheet". Thus, description thereof is not repeated herein. The content of each of the binder resin, the high molecular weight silicone and the low molecular weight silicone in the image receiving layer forming resin is also equivalent to that in the image receiving layer described in the item of "A. Thermal transfer image receiving sheet". Thus, description thereof is not repeated herein.

In the case of forming, as a film in the process, a laminate, in which a thermal insulation layer and an image receiving layer are laminated, a thermal insulation layer forming resin used to form the thermal insulation layer is a resin containing a thermoplastic resin and at least one of an incompatible resin incompatible with the thermoplastic resin or a filler. The thermoplastic resin, the incompatible resin and the filler used in the process are equivalent to those described in the item of "A. Thermal transfer image receiving sheet". Thus, description thereof is not repeated herein.

The content of each of the thermoplastic resin, the incompatible resin and the filler in the thermal insulation layer forming resin is also equivalent to that in the thermal insulation layer described in the item of "A. Thermal transfer image receiving sheet". Thus, description thereof is not repeated herein.

2. Laminating Process

Next, the laminating process in the thermal transfer image receiving sheet manufacturing method according to the embodiment is described. The laminating process in the embodiment is a process of laminating the image receiving layer formed in the image receiving layer forming process and a substrate sheet.

The method of laminating the image receiving layer and the substrate sheet in the process is not particularly limited as long as the method makes it possible to laminate the two through a desired adhesive force. In the embodiment, it is particularly preferred to use a method of using an adhesive to laminate the image receiving layer and the substrate sheet. Examples of the method of using the adhesive to attain the laminating include a method of melt-extruding the adhesive to laminate the substrate sheet and the image receiving layer; and a method of coating a laminating adhesive in a printing manner, such as gravure coating, and then performing wet-laminating or dry-laminating.

When the above-mentioned adhesive is used to attain the laminating in the process, an adhesive layer is formed in the thermal transfer image receiving sheet yielded in the embodiment.

When the image receiving layer and the substrate sheet are laminated in the process, the adhesion faces thereof are not particularly limited as long as the faces are faces on which the two can be bonded to each other. When the image receiving layer is formed as an image receiving layer laminate in the embodiment, it is particularly preferred that a different layer formed on the image receiving layer is bonded to the substrate sheet. More specifically, in the case of forming an image receiving layer laminate, in which the image receiving layer and a thermal insulation layer are laminated in the image receiving layer forming process, it is preferred in the process that the laminating is performed so as to bond the thermal insulation layer and the substrate sheet to each other.

The material used as the adhesive is equivalent to the material described in the item of "A. Thermal transfer image receiving sheet". Thus, description thereof is not repeated herein.

3. Some Other Processes

The thermal transfer image receiving sheet manufacturing method according to the embodiment may have a process other than the image receiving layer forming process and the laminating process. An example of such a process is a drawing process of drawing the image receiving layer formed in the image receiving layer forming process. In the case of forming, as a film, a laminate, in which an image receiving layer and a thermal insulation layer are laminated in the image receiving layer forming process, it is preferred to set the drawing process between the image receiving layer forming process and the laminating process. The drawing process makes it possible to cause the thermal insulation layer to have a desired void ratio.

The method of drawing the image receiving layer in the drawing process is not particularly limited as long as the method is a method making it possible to draw the layer uniformly into a desired draw ratio. For example, a method using drawing rolls as illustrated in FIG. 3, or a method using a tenter may be used. In the drawing process, drawing only into a longitudinal direction or drawing only into a transverse direction can be performed. About biaxial drawing into longitudinal and transverse directions, it is allowable to adopt an embodiment in which the layer is longitudinally drawn and then the resultant is transversely drawn, an embodiment in which the layer is transversely drawn and then the resultant is longitudinally drawn, or an embodiment in which the layer is longitudinally and transversely drawn at the same time. Furthermore, longitudinal drawing or transverse drawing may be dividedly into plural times and carried out. It is also allowable to divide the drawings and carry out some out of the divided drawings alternately.

In the drawing process, the draw ratio by area is preferably adjusted into the range of 3.6 to 25 (inclusive). This makes it possible to set the void ratio of the thermal insulation layer into the range of 15% to 65%. If the draw ratio is less than 3.6, the void ratio of the thermal insulation layer lowers so that sufficient heat resistance and cushion properties cannot be exhibited. On the other hand, if the draw ratio is over 25, conditions for the drawing are too strong so that the flatness of the drawn film unfavorably lowers. In order to adjust the draw ratio into the above-mentioned range, it is necessary to adjust appropriately, for example, the surface temperature of the drawing rolls, the temperature of the environment for the drawing treatment, the rotating speed of the drawing rolls, the running speed of the film, and so on. For example, the surface temperature of the drawing rolls when the image receiving layer is drawn and the temperature of the environment for the drawing treatment are each not lower than the glass transition temperature of the resins which constitute the materials to be drawn and lower than the melting point thereof. Specifically, the temperatures are each, for example, from 60° C. to 160° C., preferably from 80° C. to 130° C.

B. Thermal Transfer Image Receiving Sheet and Method for Manufacturing a Thermal Transfer Image Receiving Sheet According to a Second Embodiment Next, a thermal transfer image receiving sheet and a method for manufacturing a thermal transfer image receiving sheet according to a second embodiment of the invention are described.

B-1. Thermal Transfer Image Receiving Sheet According to the Second Embodiment First, the thermal transfer image receiving sheet according to the second embodiment of the invention is described.

(Substrate Sheet)

The thermal transfer image receiving sheet of the embodiment may be composed of two layers of a thermal insulation layer and an image receiving layer. However, it is desired that two layers of a thermal insulation layer and an image receiving layer, or three layers of an adhesion-improving layer, a thermal insulation layer and an image receiving layer are formed on a substrate sheet. The substrate sheet has a function of holding the thermal insulation layer, the image receiving layer and so on, and preferably has such a mechanical strength that a trouble in handling is not caused when the substrate sheet is heated since heat is applied to the substrate sheet when an image is thermally transferred to the thermal transfer image receiving sheet.

The substrate sheet used in the embodiment may be equivalent to that described in the item of "A-1. Thermal transfer image receiving sheet according to the first embodiment". Thus, detailed description thereof is not repeated herein.

(Adhesive Agent)

The adhesive which is melt-extruded at the time of laminating the substrate sheet, and the laminate made of the thermal insulation layer and the image receiving layer or the laminate made of the adhesion-improving layer, the thermal insulation layer and the image receiving layer may be equivalent to that used in the adhesive layer described in the item of "A-1. Thermal transfer image receiving sheet according to the first embodiment". Thus, detailed description thereof is not repeated herein.

The amount of the adhesive used in the embodiment may be appropriately varied, and is usually from about 1 g/m$^2$ to 50 g/m$^2$ (solid contents).

(Thermal Insulation Layer)

The thermal insulation layer is made mainly of a material, in which a thermoplastic resin and a filler are mixed with each other. The used filler is a filler, in which according to the Coulter Counter method, the average particle diameter is from 1 μm to 4 μm, and the following particle size distribution is generated: a particle size distribution in which the amount of the filler which is 1 μm or less in size is 15% or less, and the amount of the filler which is 3 μm or more in size is 15% or less. The filler is characterized in that according to the Coulter Counter method, the average particle diameter is from 1 μm to 4 μm, and the following particle size distribution is generated: a particle size distribution in which the amount of the filler which is 1 μm or less in size is 15% or less and the amount of the filler which is 3 μm or more in size is 15% or less. The Coulter Counter method is one out of methods for measuring the diameter of particles or the particle size distribution thereof. When a partition wall having one pore is set into an electrolytic solution, electrodes are set on both sides thereof and then a voltage is applied thereto, an electric current flows. The resistance thereof is decided in accordance with the volume of the pore in the partition wall. Powdery particles are dispersed in this electrolytic solution to prepare a thin liquid suspension. When one side of the partition wall is sucked, the particles are caused to pass through the pore. At this time, the amount of the electrolyte is decreased by the volume of the particles, so that the electric resistance increases. Accordingly, the amount of a change in the resistance represents the particle volume, and the generation number of a change in the resistance represents the particles; thus, the particle size distribution can be obtained.

Figure 5:
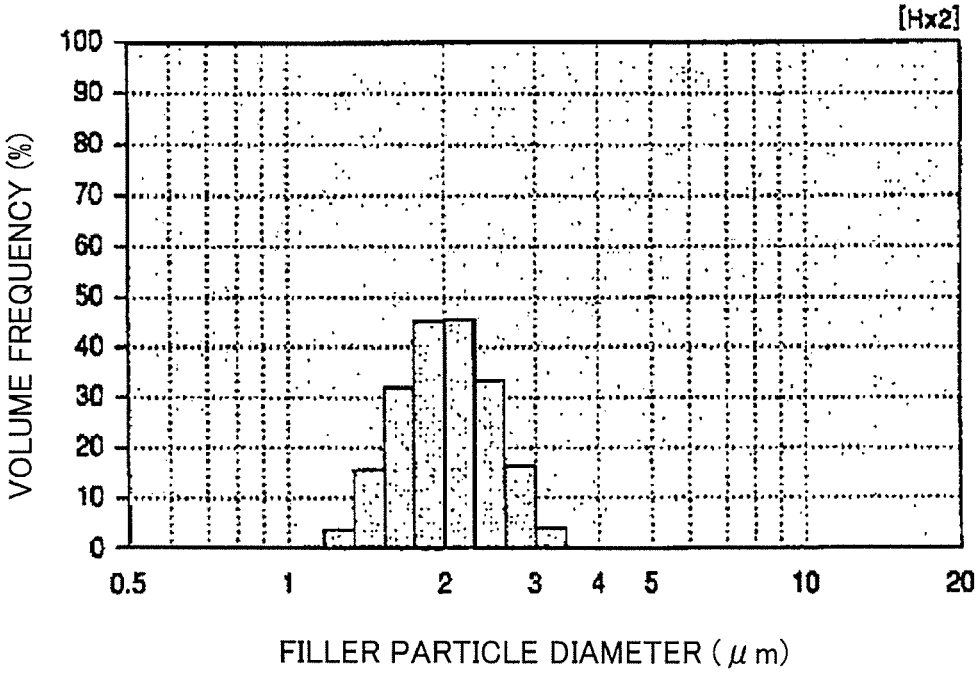
FIG. 5 is a graph showing an example of the particle size distribution of a filler used in a thermal insulation layer in a thermal transfer image receiving sheet of the invention, the distribution being based on the Coulter Counter method.

When the particle size distribution is shown in the Coulter Counter method used in the embodiment, the particle size distribution is represented by numerical values on the basis of volume. An example of a graph of the particle size distribution, based on the Coulter Counter method, of the filler used in the thermal insulation layer of the thermal transfer image receiving sheet in the embodiment is shown in FIG. 5. The particle diameter (unit: μm) of the filler is taken on the transverse axis in the graph. The volume frequency (unit: %) of the filler is taken on the vertical axis. It is demonstrated that the particle diameter ranges from 1.2 μm to 3.5 μm, and the average particle diameter is about 2 μm. It is also demonstrated that the amount of the filler which is 1.0 μm or less in size is about 0% and the amount of the filler which is 3.0 μm or more in size is about 5%. Thus, the filler in the graph satisfies the requirement that the amount of the filler which is 1 μm or less in size is 15% or less and the amount of the filler which is 3 μm or more in size is 15% or less.

As illustrated in FIG. 5, the filler used in the thermal insulation layer in the embodiment is a uniform filler having a narrow (sharp) particle size distribution, is small in the scattering of the particle diameters and having uniform particle diameters. Accordingly, the filler is melt-extruded in the thermoplastic resin, such as polyester resin, and in the drawing process voids can stably be generated in the interface between the filler and the thermoplastic resin. Thus, voids can be uniformly dispersed and formed in the thermal insulation layer. In this way, the heat resistance and the cushion properties of the thermal insulation layer are improved to give an image having a high density and a high resolution in a printed matter.

The filler is incompatible with the thermoplastic resin which is a base resin of the thermal insulation layer, is uniformly dispersed and incorporated into the thermoplastic resin, and exfoliates in the interface with the base resin when the thermal insulation layer resin is drawn, so as to become sources for generating voids. Examples of the filler include inorganic fillers such as silica, kaolin, talc, calcium carbonate, zeolite, alumina, barium sulfate, carbon black, zinc oxide, and titanium oxide; and organic fillers such as polystyrene resins, melamine resins, acrylic resins, organic silicon resins, polyamide resins such as nylon 6, nylon 66, nylon 6,10 and nylon 12, polyethylene terephthalate resin, polybutylene terephthalate resin, polycarbonate resin, polyimide resin, and polysulfone resin. As an organic filler, a product, in which any one of the above-mentioned resins is crosslinked is preferably used since the strength of the filler itself is high and the external form is not easily deformed. In the embodiment, an organic silicone resin is preferred as a filler capable of generating voids in the state that the resin is effectively and uniformly dispersed in the thermoplastic resin such as polyester resin. A specific example thereof is a filler made of a polyorganosilsesquioxane cured product having a structure crosslinked into a three-dimensional network form. As such organic silicone resin particles, SILICONE RESIN POWDERS KMP-590, KMP-701, X-52-854, and other goods manufactured by Shin-Etsu Chemical Co., Ltd. are available, and can be used.

Silicone resin coated fine particles, in which the surfaces of silicone rubber fine particles are coated with a silicone resin, as the filler in the thermal insulation layer, make it possible to generate voids in the state that the particles are effectively and uniformly dispersed in the thermoplastic resin such as polyester resin. Such silicone resin coated fine particles are available as a silicone compound powder KMP-605 manufactured by Shin-Etsu Chemical Co., Ltd., and other goods, and can be used. In order to heighten the incompatibility of the filler with the base resin of the thermal insulation layer, the filler may be surface-treated with a silicone resin, a siloxane resin, a fluorine-contained resin, a polyvinylpyridine resin or the like so as to coat the surface of the filler therewith. The thermal insulation layer contains, as essential components, a thermoplastic resin and a filler, and may optionally contain, as other added components, an antistatic agent, an ultraviolet absorbent, a plasticizer, a colorant and so on in appropriate amounts.

The thermoplastic resin which constitutes the thermal insulation layer in the embodiment may be equivalent to that described as the thermoplastic resin used in the thermal insulation layer in the item of "A-1. Thermal transfer image receiving sheet according to the first embodiment". In the embodiment, a thermoplastic resin arbitrarily blended may be used as long as the extrusion workability is kept and the resin is compatible with the others. In the embodiment, it is particularly preferred to use, as the thermoplastic resin, a polyester resin.

The polyester resin used in the embodiment is equivalent to that described as the polyester resin used in the thermal insulation layer in the item of "A-1. Thermal transfer image receiving sheet according to the first embodiment". Thus, detailed description thereof is not repeated herein.

In order to disperse sufficiently in the base thermoplastic resin and further strengthen the surface thereof to improve the physical properties further, the so-called compatibility accelerator may be used. Such a compatibility accelerator may also be equivalent to that described as the compatibility accelerator used in the thermal insulation layer in the item of "A-1. Thermal transfer image receiving sheet according to the first embodiment". Thus, detailed description thereof is not repeated herein.

The thermal insulation layer in the embodiment is formed together with the image receiving layer, which is made of a thermoplastic resin, by melt-coextrusion, and then the thermal insulation layer is subjected to drawing treatment, thereby becoming one constituent of the thermal transfer image receiving sheet. The thickness of the thermal insulation layer held in the thermal transfer image receiving sheet is from about 10 μm to 100 μm after the drawing treatment. If the thickness of the thermal insulation layer is too small, a sufficiently satisfactory heat resistance, cushion properties or the like cannot be exhibited. If the thickness is too large, there are easily caused problems such that the heat resistance and the mechanical strength fall.

(Adhesion-Improving Layer)

When the above-mentioned substrate sheet is laminated onto a laminate composed of a thermal insulation layer and an image receiving layer by use of an adhesive, it is preferred to form an adhesion-improving layer in order to improve the adhesiveness between the adhesive layer and the thermal insulation layer. In other words, a thermal transfer image receiving sheet having the following layer structure is manufactured: substrate sheet/adhesive layer/adhesion-improving layer/thermal insulation layer/image receiving layer. The resin which constitutes the adhesion-improving layer is not limited as long as the resin has adhesiveness to the adhesive layer and the thermal insulation layer and can be worked by melt-extrusion.

(Image Receiving Layer)

The thermal transfer image receiving sheet of the embodiment is a thermal transfer image receiving sheet composed of at least a thermal insulation layer and an image receiving layer. In this thermal transfer image receiving sheet, the image receiving layer is made of a thermoplastic resin. The thermal insulation layer which is composed of a thermoplastic resin and a filler and the image receiving layer are formed by melt-coextrusion, and then the resultant is subjected to drawing treatment, thereby forming a film laminate. The image receiving layer is made mainly of a thermoplastic resin, and the thermoplastic resin described in the thermal insulation layer may be used as it is. The image receiving layer has no voids. In the image receiving layer, polyester resin, out of thermoplastic resins which may each become a base resin, is preferably used. About the resin, two or more species thereof may be used in a blend form as long as the extrusion workability is kept and the species are compatible with the others. The image receiving layer preferably contains polyester resin, out of the above-mentioned thermoplastic resins, and more preferably contains amorphous polyester resin to such an extent that the extrusion workability is not damaged.

The polyester resin is, for example, polyester resin obtained by polycondensing an aromatic dicarboxylic acid such as terephthalic acid, isophthalic acid or naphthalenedicarboxylic acid, or an ester thereof, and a glycol such as ethylene glycol, diethylene glycol, 1,4-butanediol or neopentyl glycol. Typical examples of this polyester resin include polyethylene terephthalate resin, polybutylene terephthalate resin, polyethylene/butylene terephthalate, and polyethylene-2,6-naphthalate. These polyesters may each be a homopolymer or a copolymer, in which a third component is also copolymerized.

As the above-mentioned polyester resin, an amorphous polyester resin may be used. The amorphous polyester resin is as follows: first, the polyester resin is any polyester resin as long as the resin is substantially amorphous; and the amorphous polyester resin is equivalent to that described in the above-mentioned item of "A-1. Thermal transfer image receiving sheet according to the first embodiment". Thus, detailed description thereof is not repeated herein.

The resin which constitutes the image receiving layer may be melted and bonded to a binder resin in a dye layer for keeping a dye at the time of thermal transfer for forming an image. Thus, it is preferred to add various releasing agents internally to a resin for forming the image receiving layer, examples of the agents being a phosphate ester, a surfactant, a fluorine-contained compound, a fluorine-contained resin, a silicone compound, a silicone oil, and a silicon resin. A resin cured by the addition of a modified silicone oil is particularly preferred.

About the releasing agents, one or more thereof may be used. The addition amount of the releasing agent (s) is preferably from 0.5 to 30 parts by mass for 100 parts by mass of the image receiving layer forming resin. If the addition amount does not satisfy this addition amount range, there may be caused problems such that the dye receiving layer of the thermal transfer image receiving sheet and a sublimation type thermal transfer sheet are melted and bonded to each other, and the print sensitivity falls. By the addition of such a releasing agent to the image receiving layer, the releasing agent bleeds out onto the surface of the image receiving layer so that a releasing layer is formed. Without adding the releasing agent to the image receiving layer forming resin, the releasing agent may be separately coated onto the image receiving layer. The thickness of the image receiving layer is from about 10 μm to 100 μm after the layer is drawn.

The thermal transfer image receiving sheet of the embodiment is not limited to the above description, and optionally a layer may be added thereto, for example, a rear face layer is formed on the other side of the substrate sheet, or an intermediate layer is formed between any one of the illustrated layers and a layer adjacent thereto.

Figure 4:
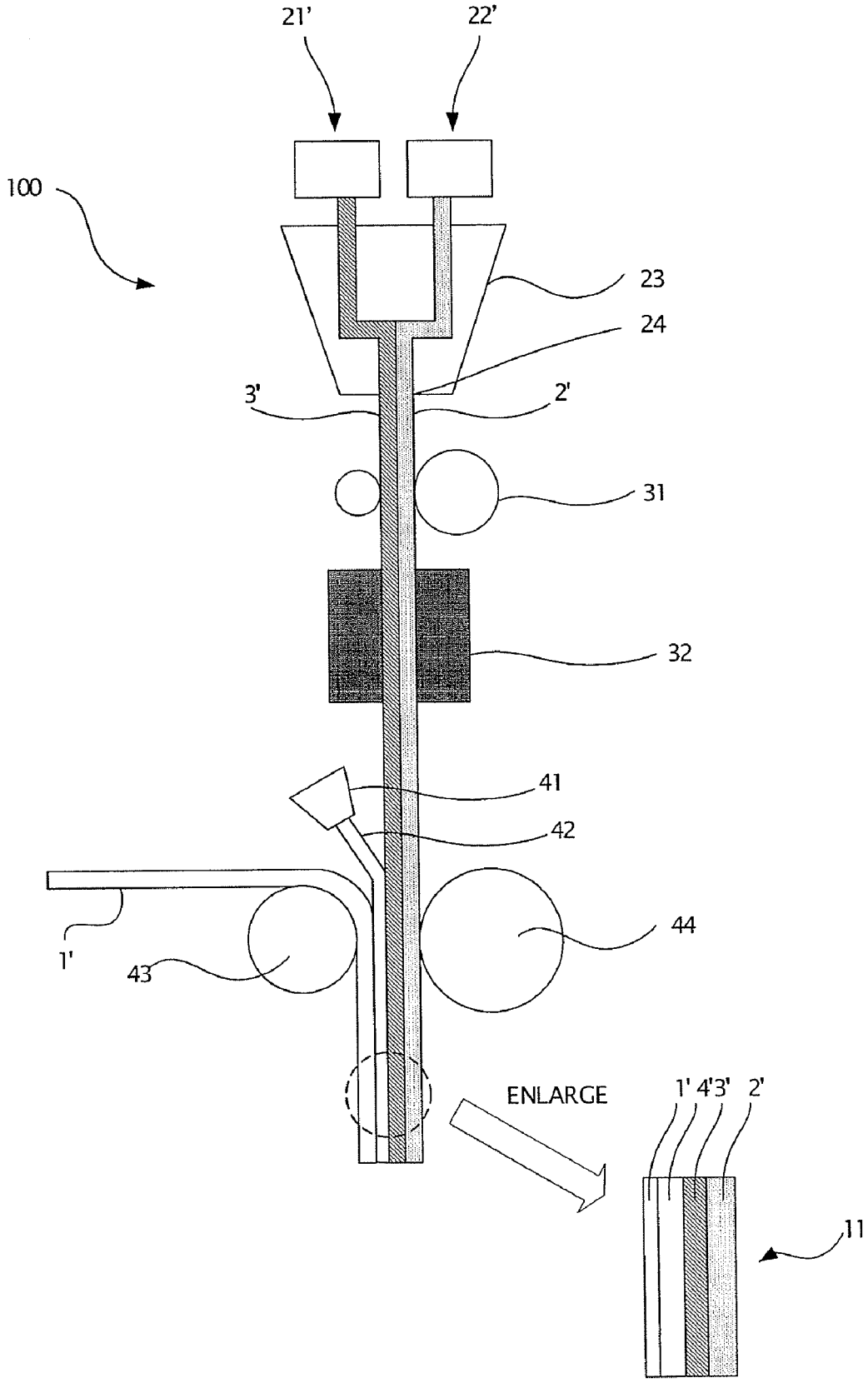
FIG. 4 is a schematic view illustrating an example of a manufacturing apparatus with reference to which the method of the invention for manufacturing a thermal transfer image receiving sheet is described.

B-2. Method for Manufacturing a Thermal Transfer Image Receiving Sheet According to the Second Embodiment Next, a method for manufacturing a thermal transfer image receiving sheet according to the second embodiment of the present embodiment is described. The thermal transfer image receiving sheet manufacturing method according to the embodiment is described, giving a manufacturing apparatus 100 illustrated in FIG. 4 as an example. First, a thermal insulation layer forming resin 21', in which a polyester resin and a filler are mixed, and an image receiving layer forming resin 22' made of a polyester resin are supplied, through different paths, to a die head 23. The thermal insulation layer forming resin and the image receiving layer forming resin are coextruded, in a state that they are melted, from an outlet 24 in the die head 23, thereby forming a film layer composed of two layers of an image receiving layer 2' and a thermal insulation layer 3'. Subsequently, a pair of drawing rolls 31 is caused to have peripheral velocities different from each other, and is used to draw the film layer. A tenter type transversely-drawing machine 32 is then used to subject the resultant film to transversely drawing treatment, thereby forming a laminate composed of two layers of the image receiving layer 2' and the thermal insulation layer 3'. The laminate composed of the two layers can constitute a thermal transfer image receiving sheet. Thereafter, an adhesive 42 is optionally melt-extruded from a die head 41, and a supplied substrate sheet 1' and the above-mentioned laminate are passed, with the adhesive 42 interposed therebetween, between a laminate roll 12 and a press roll 13, and pressed by means of the two rolls, so as to attain EC laminating, thereby manufacturing a thermal transfer image receiving sheet 11, in which the adhesive layer 4', the thermal insulation layer 3' and the image receiving layer 2' are formed in this order on the substrate sheet 1'. In the above-mentioned example, as the heat insulating material and the image receiving layer forming resin, materials, in which a polyester resin is used have been described. However, the material and the resin are not limited thereto, and it is allowable to use a thermal insulation layer forming resin, in which a thermoplastic resin other than any polyester resin and a filter are mixed, and an image receiving layer forming resin made of a thermoplastic resin other than any polyester resin.

As an example of the thermal transfer image receiving sheet manufacturing method according to the embodiment, there will be described a thermal transfer image receiving sheet having a structure, in which an adhesive layer, an adhesion-improving layer, a thermal insulation layer and an image receiving layer are formed in this order on a substrate sheet; however, the sheet is not illustrated. An adhesion-improving layer made of a thermoplastic resin such as a polyester resin, a thermal insulation layer forming resin, in which a thermoplastic resin, such as a polyester resin, and a filler are mixed with each other, and an image receiving layer forming resin made of a thermoplastic resin, such as a polyester resin, are supplied through different paths to a die head. The adhesion-improving layer forming resin, the thermal insulation layer forming resin, and the image receiving layer forming resin are coextruded, in the state that they are melted, from an outlet in the die head, thereby forming a film layer composed of three layers of an adhesion-improving layer, an image receiving layer, and a thermal insulation layer. Subsequently, a pair of drawing rolls is caused to have peripheral velocities different from each other, and is used to draw the film layer longitudinally. A tenter type transversely-drawing machine is then used to subject the resultant film to transversely drawing treatment, thereby forming a laminate composed of three layers of the adhesion-improving layer, the image receiving layer and the thermal insulation layer. This laminate, which is composed of the three layers, can constitute a thermal transfer image receiving sheet. Thereafter, an adhesive is optionally melt-extruded from a die head, and a supplied substrate sheet and the above-mentioned laminate are passed, with the adhesive interposed therebetween, between a laminate roll and a press roll, and pressed by means of the two rolls so as to attain EC laminating, thereby manufacturing a thermal transfer image receiving sheet, in which the adhesive layer, the adhesion-improving layer, the thermal insulation layer and the image receiving layer are formed in this order on the substrate sheet (see FIG. 4).

(Method for Manufacturing a Thermal Transfer Image Receiving Sheet)

The thermal transfer image receiving sheet manufacturing method according to the embodiment is roughly classified into two. The first is a method for manufacturing a thermal transfer image receiving sheet composed of a thermal insulation layer and an image receiving layer, and is a process of forming a thermal insulation layer made of a thermoplastic resin such as a polyester resin and a filler, and an image receiving layer made of a thermoplastic resin by melt-coextrusion, and then subjecting the resultant layers to drawing treatment, thereby forming a film laminate. The second is a method for manufacturing a thermal transfer image receiving sheet composed of an adhesion-improving layer, a thermal insulation layer and an image receiving layer, and is a process of forming an adhesion-improving layer made of a thermoplastic resin, a thermal insulation layer made of a thermoplastic resin, such as a polyester resin, and a filler, and an image receiving layer made of a thermoplastic resin by melt-coextrusion, and then subjecting the resultant layers to drawing treatment, thereby forming a film laminate. In any of the two processes, it is preferred to supply a substrate sheet, and melt-extrude the substrate sheet, and a laminate made of a thermal insulation layer and an image receiving layer or a laminate made of an adhesion-improving layer, a thermal insulation layer and an image receiving layer so as to laminate them. The lamination of the substrate sheet makes it possible to improve the curling preventing properties, and physical strength in handling the sheet.

The above-mentioned melt-extrusion may be a method using a T die, an inflation method using a round die, or some other extrusion. The above-mentioned coextrusion may be a field block method, a multi-manifold method, a co-extrusion using a T die such as a multi-slot die method, or a co-extrusion method based on an inflation manner. The drawing treatment is not limited to the longitudinal and transverse drawing as illustrated in the figure, and drawing only into a longitudinal direction or drawing only into a transverse direction may be performed. Biaxial drawing into longitudinal and transverse directions is not limited to an embodiment, in which transverse drawing treatment is conducted after longitudinal drawing, as illustrated in the figure. Thus, the drawing may be an embodiment, in which longitudinal drawing is conducted after transverse drawing, or an embodiment, in which longitudinal and transverse drawings are simultaneously conducted. Moreover, longitudinal drawing or transverse drawing may be dividedly carried out. It is also allowable to divide the drawings and carry out some out of the divided drawings alternately.

In the above-mentioned drawing process of the embodiment, the draw ratio by area is preferably adjusted into the range of 3.6 to 25 (inclusive). If the draw ratio is less than 3.6, the drawing is not sufficiently performed. Thus, voids are not sufficiently generated in the drawn film, so that sufficient heat resistance and cushion properties cannot be exhibited. On the other hand, if the draw ratio is over 25, conditions for the drawing are too strong so that the flatness of the drawn film unfavorably lowers. In order to adjust the draw ratio into the above-mentioned range, it is necessary to adjust appropriately, for example, the surface temperature of the drawing rolls, the temperature of the environment for the drawing treatment, the rotating speed of the drawing rolls, or the running speed of the film. For example, the surface temperature of the drawing rolls at the time of the drawing and the temperature of the environment for the drawing treatment are each not lower than the glass transition temperature of the resins which constitute the materials to be drawn and lower than the melting point thereof. Specifically, the temperatures are each, for example, from 60° C. to 160° C., preferably from 80° C. to 130° C.

In the manufacturing method according to the embodiment, it is preferred to supply a substrate sheet, and melt-extrude the substrate sheet and a laminate made of a thermal insulation layer and an image receiving layer or a laminate made of an adhesion-improving layer, a thermal insulation layer and an image receiving layer so as to laminate them. About conditions for the laminating, an adhesive may be melt-extruded to laminate the substrate sheet and the laminate which is made of the thermal insulation layer and the image receiving layer, or the laminate which is made of the adhesion-improving layer, the thermal insulation layer and the image receiving layer; or an adhesive is coated in a printing manner such as gravure coating, and then wet-laminating or dry-laminating may be performed. After the above-mentioned melt-extruding process, drawing treatment process and process of laminating the substrate sheet, calendaring treatment may be conducted, thereby making it possible to yield a flatter or smoother thermal transfer image receiving sheet.

The invention is not limited to the above-mentioned embodiments. The embodiments are examples and any embodiment which has substantially the same as the technical conception recited in the claims of the invention and produces the same effects and advantageous is included in the technical scope of the invention.

EXAMPLES

The present invention will be more specifically described by way of the following examples.

1. The Thermal Transfer Image Receiving Sheet and the Thermal Transfer Image Receiving Sheet Manufacturing Method According to the First Embodiment First, about the thermal transfer image receiving sheet and the thermal transfer image receiving sheet manufacturing method according to the first embodiment of the invention, working examples and comparative examples thereof are described.

Example 1

An image receiving layer forming resin, a thermal insulation layer forming resin and an adhesive layer forming resin each having a composition described below were used to form an image receiving layer 36 μm in thickness, to which a thermal insulation layer 360 μm in thickness and an adhesion-improving layer 36 μm in thickness were laminated in this order by melt-extrusion. The thus-formed image receiving layer was drawn at a draw ratio by area of 9 by means of a biaxial drawing machine manufactured by TOYO SEIKI Co., Ltd., and then the layer was set at 240° C. for 1 minute, thereby yielding a film of image receiving layer/thermal insulation layer/adhesive layer, 48 μm in thickness, having fine voids.

⟨Image Receiving Layer Forming Resin (Example 1)⟩

| | |
|---|---|
| Polyester resin (VYLON 290, manufactured by TOYOBO., LTD.): | 100 parts by weight |
| High molecular weight dimethylsilicone oil (SH-200 (kinematic viscosity: 1000000 $mm^2/s$), manufactured by Dow Corning Toray Co., Ltd.): | 0.5 part by weight |
| Low molecular weight-modified silicone oil (X-22-3939A, manufactured by Shin-Etsu Chemical Co., Ltd.): | 0.5 part by weight |

⟨Thermal Insulation Layer Forming Resin⟩

| | |
|---|---|
| Polyethylene terephthalate resin (KR-565, manufactured by Mitsubishi Rayon Co., Ltd.): | 85 parts by weight |
| Silicone filler (KMP-590, Shin-Etsu Chemical Co., Ltd.): | 15 parts by weight |

⟨Adhesive Layer Forming Resin⟩

| | |
|---|---|
| Polyester resin (SI-173, manufactured by TOYOBO., LTD.): | 70 parts by weight |
| EMAA resin (Nucrel ® N09008C, manufactured by Du Pont-Mitsui Polychemicals Co., Ltd.): | 30 parts by weight |

An adhesive (EMAA resin (Nucrel® N09008C, manufactured by DuPont-Mitsui Polychemicals Co., Ltd.)) was used to melt-extrude and laminate thermally the adhesion-improving layer side of the above-mentioned film of "image receiving layer/thermal insulation layer/adhesive layer", and the core paper side of a substrate sheet on which a core paper 150

μm in thickness and a PET 25 μm in thickness were stuck, thereby yielding a thermal transfer image receiving sheet of Example 1.

Example 2

A thermal transfer image receiving sheet was formed in the same way as in Example 1 except that the image receiving layer forming resin was changed so as to have a composition described below. The yielded sheet was a thermal transfer image receiving sheet of Example 2.

⟨Image Receiving Layer Forming Resin (Example 2)⟩

| | |
|---|---|
| Polyester resin (VYLON 290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 0.25 part by weight |
| Low molecular weight-modified silicone oil (X-22-3939A, manufactured by Shin-Etsu Chemical Co., Ltd.): | 0.75 part by weight |

Example 3

A thermal transfer image receiving sheet was formed in the same way as in Example 1 except that the image receiving layer forming resin was changed so as to have a composition described below. The yielded sheet was a thermal transfer image receiving sheet of Example 3.

⟨Image Receiving Layer Forming Resin (Example 3)⟩

| | |
|---|---|
| Polyester resin (VYLON290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 0.75 part by weight |
| Low molecular weight-modified silicone oil (X-22-3939A, manufactured by Shin-Etsu Chemical Co., Ltd.): | 0.25 part by weight |

Example 4

A thermal transfer image receiving sheet was formed in the same way as in Example 1 except that the image receiving layer forming resin was changed so as to have a composition described below. The yielded sheet was a thermal transfer image receiving sheet of Example 4.

⟨Image Receiving Layer Forming Resin (Example 4)⟩

| | |
|---|---|
| Polyester resin (VYLON 290, manufactured by TOYOBO., LTD.): | 100 parts by weight |
| Super high molecular weight dimethylsilicone oil (SH-200 (kinematic viscosity: 500000 $mm^2/s$), manufactured by Dow Corning Toray Co., Ltd.): | 0.5 part by weight |
| Low molecular weight-modified silicone oil (X-22-3939A, manufactured by Shin-Etsu Chemical Co., Ltd.): | 0.5 part by weight |

Example 5

A thermal transfer image receiving sheet was formed in the same way as in Example 1 except that the image receiving layer forming resin was changed so as to have a composition described below. The yielded sheet was a thermal transfer image receiving sheet of Example 5.

⟨Image Receiving Layer Forming Resin (Example 5)⟩

| | |
|---|---|
| Polyester resin (VYLON 290, manufactured by TOYOBO., LTD.): | 99.5 parts by weight |
| Super high molecular weight dimethylsilicone master batch (MB50-010, active Si ingredient 50%, manufactured by Dow Corning): | 1 part by weight |
| Low molecular weight-modified silicone oil (X-22-3939A, manufactured by Shin-Etsu Chemical Co., Ltd.): | 0.5 part by weight |

Example 6

A thermal transfer image receiving sheet was formed in the same way as in Example 1 except that the image receiving layer forming resin was changed so as to have a composition described below. The yielded sheet was a thermal transfer image receiving sheet of Example 6.

⟨Image Receiving Layer Forming Resin (Example 6)⟩

| | |
|---|---|
| Polyester resin (VYLON 290, manufactured by TOYOBO., LTD.): | 100 parts by weight |
| Silicone varnish (YR3370, manufactured by GE Toshiba Silicones): | 0.5 part by weight |
| Low molecular weight-modified silicone oil (X-22-3939A, manufactured by Shin-Etsu Chemical Co., Ltd.): | 0.5 part by weight |

Example 7

A thermal transfer image receiving sheet was formed in the same way as in Example 1 except that the image receiving layer forming resin was changed so as to have a composition described below. The yielded sheet was a thermal transfer image receiving sheet of Example 7.

⟨Image Receiving Layer Forming Resin (Example 7)⟩

| | |
|---|---|
| Polyester resin (VYLON 290, manufactured by TOYOBO., LTD.): | 100 parts by weight |
| Silicone modified acrylate resin (X-22-8171, manufactured by Shin-Etsu Chemical Co., Ltd.): | 0.5 part by weight |
| Low molecular weight-modified silicone oil (X-22-3939A, manufactured by Shin-Etsu Chemical Co., Ltd.): | 0.5 part by weight |

Example 8

A thermal transfer image receiving sheet was formed in the same way as in Example 1 except that the image receiving layer forming resin was changed so as to have a composition described below. The yielded sheet was a thermal transfer image receiving sheet of Example 8.

⟨Image Receiving Layer Forming Resin (Example 8)⟩

| | |
|---|---|
| Polyester resin (VYLON 290, manufactured by TOYOBO., LTD.): | 100 parts by weight |
| polyester modified silicone (X-22-6133, manufactured by Shin-Etsu Chemical Co., Ltd.): | 0.5 part by weight |
| Low molecular weight-modified silicone oil (X-22-3939A, manufactured by Shin-Etsu Chemical Co., Ltd.): | 0.5 part by weight |

Example 9

A thermal transfer image receiving sheet was formed in the same way as in Example 1 except that the image receiving layer forming resin was changed so as to have a composition described below. The yielded sheet was a thermal transfer image receiving sheet of Example 9.

⟨Image Receiving Layer Forming Resin (Example 9)⟩

| | |
|---|---|
| Polyester resin (VYLON 290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 0.5 part by weight |
| Low molecular weight-modified silicone oil (TSF4452, manufactured by GE Toshiba Silicones): | 0.5 part by weight |

Example 10

A thermal transfer image receiving sheet was formed in the same way as in Example 1 except that the image receiving layer forming resin was changed so as to have a composition described below. The yielded sheet was a thermal transfer image receiving sheet of Example 10.

⟨Image Receiving Layer Forming Resin (Example 10)⟩

| | |
|---|---|
| Polyester resin (Vylon 290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 0.5 part by weight |
| Low molecular weight-modified silicone oil (TSF4452, manufactured by GE Toshiba Silicones): | 0.5 part by weight |

Example 11

A thermal transfer image receiving sheet was formed in the same way as in Example 1 except that the image receiving layer forming resin was changed so as to have a composition described below. The yielded sheet was a thermal transfer image receiving sheet of Example 11.

⟨Image Receiving Layer Forming Resin (Example 11)⟩

| | |
|---|---|
| Polyester resin (Vylon 290, manufactured by TOYOBO., LTD.): | 100 parts by weight |
| polycarbodiimide resin (HMV-8CA, manufactured by Nisshinbo Industries, Inc.): | 3 parts by weight |
| Super high molecular weight dimethylsilicone oil (SH-200 (kinematic viscosity: 1000000 $mm^2/s$), manufactured by Dow Corning Toray Co., Ltd.): | 0.5 part by weight |
| Low molecular weight-modified silicone oil (X-22-3939A, manufactured by Shin-Etsu Chemical Co., Ltd.): | 0.5 part by weight |

Comparative Example 1

A thermal transfer image receiving sheet was formed in the same way as in Example 1 except that the image receiving layer forming resin was changed so as to have a composition described below. The yielded sheet was a thermal transfer image receiving sheet of Comparative Example 1.

⟨Image Receiving Layer Forming Resin (Comparative Example 1)⟩

| | |
|---|---|
| Polyester resin (Vylon 290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 1 part by weight |

Comparative Example 2

A thermal transfer image receiving sheet was formed in the same way as in Example 1 except that the image receiving layer forming resin was changed so as to have a composition described below. The yielded sheet was a thermal transfer image receiving sheet of Comparative Example 2.

⟨Image Receiving Layer Forming Resin (Comparative Example 2)⟩

| | |
|---|---|
| Polyester resin (Vylon 290, manufactured by TOYOBO., LTD.): | 99 parts by weight |
| Super high molecular weight dimethylsilicone master batch (MB50-010, active Si ingredient 50%, manufactured by Dow Corning): | 2 parts by weight |

Comparative Example 3

A thermal transfer image receiving sheet was formed in the same way as in Example 1 except that the image receiving layer forming resin was changed so as to have a composition described below. The yielded sheet was a thermal transfer image receiving sheet of Comparative Example 3.

⟨Image Receiving Layer Forming Resin (Comparative Example 3)⟩

| | |
|---|---|
| Polyester resin (Vylon 290, manufactured by TOYOBO., LTD.): | 100 parts by weight |
| Low molecular weight-modified silicone oil (X-22-3939A, manufactured by Shin-Etsu Chemical Co., Ltd.): | 1 part by weight |

Comparative Example 4

A thermal transfer image receiving sheet was formed in the same way as in Example 1 except that the image receiving layer forming resin was changed so as to have a composition described below. The yielded sheet was a thermal transfer image receiving sheet of Comparative Example 4.

⟨Image Receiving Layer Forming Resin (Comparative Example 4)⟩

| | |
|---|---|
| Polyester resin (Vylon 290, manufactured by TOYOBO., LTD.): | 100 parts by weight |
| Super high molecular weight dimethylsilicone oil (SH-200 (kinematic viscosity: 1000000 $mm^2/s$), manufactured by Dow Corning Toray Co., Ltd.): | 5 parts by weight |

Comparative Example 5

A thermal transfer image receiving sheet was formed in the same way as in Example 1 except that the image receiving layer forming resin was changed so as to have a composition described below. The yielded sheet was a thermal transfer image receiving sheet of Comparative Example 5.

⟨Image Receiving Layer Forming Resin (Comparative Example 5)⟩

| | |
|---|---|
| Polyester resin (Vylon 290, manufactured by TOYOBO., LTD.): | 100 parts by weight |
| Low molecular weight-modified silicone oil (X-22-3939A, manufactured by Shin-Etsu Chemical Co., Ltd.): | 5 parts by weight |

(Evaluation)

Next, the thermal transfer image receiving sheets of the above-mentioned working examples and comparative examples were evaluated.

(1) Releasability

⟨Evaluating Method⟩

A sublimation transfer printer CP-400 manufactured by Canon Inc. and thermal transfer films were used, and the thermal transfer image receiving sheets of the above-mentioned working examples and comparative examples were used to print black solid images. When Y, M and C were printed, the releasability was evaluated with the naked eye.

⟨Evaluating Criterion⟩

The evaluating criterion of the evaluation with the naked eye is as follows:

5: A sheet is released.

4: A sheet is released, but exfoliation sounds are large.

3: A sheet is released, but abnormal transfer is caused in less than 30% of image areas.

2: A sheet is released, but abnormal transfer is caused in 30% or more of image areas.

1: A sheet is melted and bonded to the ribbon.

(2) Print Sensitivity

⟨Evaluating Method⟩

(Thermal Transfer Print)

A transfer film UPC-740 for a sublimation transfer printer UP-D70A manufactured by Sony Corporation was used as a thermal transfer film, and each of the thermal transfer image receiving sheets of the above-mentioned working examples and comparative examples was used, and they were stacked onto each other to oppose the dye layer and the dye receiving face. A thermal head was used to make thermal transfer prints from the rear face of the thermal transfer film in order of its Y, M, C and protective layer.

(Image Printing A)

A gradation image was formed by thermal transfer print under the following conditions:

Thermal head: KYT-86-12MFW11 (manufactured by KYOCERA Corporation)

Average heater-resistance: 4412Ω

Main scanning direction print density: 300 dpi

Vertical scanning direction print density: 300 dpi

Applied electric power: 0.136 w/dot

One line-cycle: 6 msec.

Print starting temperature: 30° C.

Print size: 100 mm×150 mm

Gradation print: A multipluse type test printer was used, in which the number of division pulses each having a pulse length obtained by dividing the line-cycle equally into 256 was able to be varied from 0 to 255 in any line-cycle. The duty ratio of each of the division pulses was fixed to 40%. In accordance with gradation, the number of the pulses per line-cycle was set to 0 at step 1, that was set to 17 at step 2, and that was set to 34 at step 3. In such a way, the number of the pulses was gradually increased seventeen by seventeen from 0 to 255, thereby controlling 16 gradation steps from step 1 to step 16.

Transfer of the protective layer: A multipluse type test printer was used, in which the number of division pulses each having a pulse length obtained by dividing the line-cycle equally into 256 was able to be varied from 0 to 255 in any line-cycle. The duty ratio of each of the division pulses was fixed to 50%, and the number of the pulses was fixed to 210 per line-cycle. A solid image was then printed, and the protective layer was transferred onto the printed face.

⟨Evaluating Criterion⟩

An optical reflection densitometer (Macbeth RD-918, manufactured by Macbeth Co.) was used to measure the maximum reflection density of the above-mentioned printed matter through a visual filter.

Rate ○: maximum reflection density of 2.0 or more

Rate X: maximum reflection density of less than 2.0

The above-mentioned evaluation results are shown in Table 1.

TABLE 1

| | High molecular weight silicone | | | Low molecular weight-modified silicone | | | Added releasing agent total amount | Some other additive | | Releasability | | | Print sensitivity |
|---|---|---|---|---|---|---|---|---|---|---|---|---|---|
| | Name | Viscosity (Cs) | Added Si amount (%) | Name | Viscosity | Added Si amount (%) | 1 | Name | Added amount (%) | Y | M | C | |
| Example 1 | SH200-1000000 | 1000000 | 0.5 | x-22-3939A | 3300 | 0.5 | 1 | — | — | 5 | 5 | 5 | ○ |
| Example 2 | SH200-1000000 | 1000000 | 0.25 | x-22-3939A | 3300 | 0.75 | 1 | — | — | 5 | 5 | 5 | ○ |
| Example 3 | SH200-1000000 | 1000000 | 0.75 | x-22-3939A | 3300 | 0.25 | 1 | — | — | 5 | 5 | 5 | ○ |
| Example 4 | SH200-500000 | 500000 | 0.5 | x-22-3939A | 3300 | 0.5 | 1 | — | — | 5 | 5 | 5 | ○ |
| Example 5 | MB50-010 | Gum-form Si portions | 0.5 | x-22-3939A | 3300 | 0.5 | 1 | — | — | 5 | 5 | 5 | ○ |
| Example 6 | YR-3370 | Varnish | 0.5 | x-22-3939A | 3300 | 0.5 | 1 | — | — | 5 | 5 | 5 | ○ |
| Example 7 | x-22-8171 | Solid | 0.5 | x-22-3939A | 3300 | 0.5 | 1 | — | — | 5 | 5 | 5 | ○ |
| Example 8 | x-22-6133 | Solid | 0.5 | x-22-3939A | 3300 | 0.5 | 1 | — | — | 5 | 5 | 5 | ○ |
| Example 9 | SH200-1000000 | 1000000 | 0.5 | TSF4452 | 900 | 0.5 | 1 | — | — | 5 | 5 | 5 | ○ |
| Example 10 | SH200-1000000 | 1000000 | 0.5 | TSF4702 | 500 | 0.5 | 1 | — | — | 5 | 5 | 5 | ○ |
| Example 11 | SH200-1000000 | 1000000 | 0.5 | x-22-3939A | 3300 | 0.5 | 1 | HMV-8CA | 3 | 5 | 5 | 5 | ○ |
| Comparative Example 1 | SH200-1000000 | 1000000 | 1 | — | — | — | 1 | — | — | 3 | 2 | 2 | ○ |
| Comparative Example 2 | MB50-010 | Gum-form Si portions | 1 | — | — | — | 1 | — | — | 3 | 3 | 2 | ○ |
| Comparative Example 3 | — | — | — | x-22-3939A | 3300 | 1 | 1 | — | — | 5 | 2 | 1 | ○ |
| Comparative Example 4 | SH200-1000000 | 1000000 | 5 | — | — | — | 5 | — | — | 4 | 3 | 2 | X |
| Comparative Example 5 | — | — | — | x-22-3939A | 3300 | 5 | 5 | — | — | 5 | 3 | 1 | ○ |

As shown in Table 1, according to the invention, a thermal transfer image receiving sheet excellent in releasability and release stability can be obtained.

2. The Thermal Transfer Image Receiving Sheet and the Thermal Transfer Image Receiving Sheet Manufacturing Method According to the Second Embodiment Next, about the thermal transfer image receiving sheet and the thermal transfer image receiving sheet manufacturing method according to the second embodiment of the invention, working examples and comparative examples thereof are described.

Example 12

An image receiving layer forming resin, a thermal insulation layer forming resin and an adhesion-improving layer each having a composition described below were melt-coextruded into a thickness of 36 μm, that of 360 μm and that of 36 μm, respectively. The resultant was drawn at a draw ratio by area of 9 by means of a biaxial drawing machine manufactured by TOYO SEIKI Co., Ltd., thereby yielding a film of "image receiving layer/thermal insulation layer/adhesion-improving layer", 48 μm in thickness, having fine voids.

⟨Image Receiving Layer Forming Resin (Example 12)⟩

| | |
|---|---|
| Polyester resin (Vylon 290, manufactured by TOYOBO., LTD.): | 100 parts by weight |
| Silicone oil master batch (X-22-2158, manufactured by Shin-Etsu Chemical Co., Ltd.): | 2 parts by weight |

⟨Thermal Insulation Layer Forming Resin (Example 12)⟩

| | |
|---|---|
| Polyester resin (DIANITEMA-521H, manufactured by Mitsubishi Rayon Co., Ltd.): | 85 parts by weight |
| Silicone filler (KMP-590, Shin-Etsu Chemical Co., Ltd., particle size distribution: 1 to 4 μm): | 15 parts by weight |

⟨Adhesion-Improving Layer Forming Resin (Example 12)⟩

| | |
|---|---|
| Polyester resin (SI-173, manufactured by TOYOBO., LTD.): | 70 parts by weight |
| EMAA resin (Nucrel ® N09008C, manufactured by Du Pont-Mitsui Polychemicals Co., Ltd.): | 30 parts by weight |

An adhesive having a composition described below was used to melt-extrude and laminate thermally the adhesion-improving layer side of the above-mentioned film of image receiving layer/thermal insulation layer/adhesion-improving layer and the non-rear-face side of a substrate sheet (rear face layer/substrate sheet) having requirements described below, thereby yielding a thermal transfer image receiving sheet of Example 12.

A rear face layer having a composition described below was thermally melt-extruded into a thickness of 25 μm onto one surface of a double side coated paper, in which the weight per unit area was 158/m$^2$, thereby yielding a substrate sheet.

⟨Rear Face Layer Material (Example 12)⟩

| | |
|---|---|
| Polypropylene (J-aromer LR711-5, manufactured by Japan Polyolefins Co., Ltd.): | 100 parts by weight |

⟨Adhesive Material (Example 12)⟩

| | |
|---|---|
| EMAA resin (Nucrel ® N09008C, manufactured by Du Pont-Mitsui Polychemicals Co., Ltd.): | 100 parts by weight |

Example 13

A thermal transfer image receiving sheet of Example 13 was yielded in the same way as in Example 12 except that the thermal insulation layer forming resin in Example 12 was changed to have a composition described below.

⟨Thermal Insulation Layer Forming Resin (Example 13)⟩

| | |
|---|---|
| Polyester resin (DIANITEMA-521H, manufactured by Mitsubishi Rayon Co., Ltd.): | 92 parts by weight |
| Silicone filler (KMP-590, manufactured by Shin-Etsu Chemical Co., Ltd., particle size distribution: 1 to 4 μm): | 8 parts by weight |

Example 14

A thermal transfer image receiving sheet of Example 14 was yielded in the same way as in Example 12 except that the thermal insulation layer forming resin in Example 12 was changed to have a composition described below.

⟨Thermal Insulation Layer Forming Resin (Example 14)⟩

| | |
|---|---|
| Polyester resin (DIANITEMA-521H, manufactured by Mitsubishi Rayon Co., Ltd.): | 85 parts by weight |
| Crosslinked acryl particles (MX-180TA, manufactured by Soken Chemical & Engineering Co., Ltd., particle size distribution: 1 to 3.5 μm): | 15 parts by weight |

Example 15

A thermal transfer image receiving sheet of Example 15 was yielded in the same way as in Example 12 except that the thermal insulation layer forming resin in Example 12 was changed to have a composition described below.

⟨Thermal Insulation Layer Forming Resin (Example 15)⟩

| | |
|---|---|
| Polyester resin (DIANITEMA-521H, manufactured by Mitsubishi Rayon Co., Ltd.): | 85 parts by weight |
| calcium carbonate filler (CUBE type, manufactured by MARUO CALCIUM CO., LTD., particle size distribution: 1 to 4 μm): | 15 parts by weight |

Example 16

A thermal transfer image receiving sheet of Example 16 was yielded in the same way as in Example 12 except that the thermal insulation layer forming resin in Example 12 was changed to have a composition described below.

⟨Thermal Insulation Layer Forming Resin (Example 16)⟩

| | |
|---|---|
| Polyester resin (DIANITEMA-521H, manufactured by Mitsubishi Rayon Co., Ltd.): | 85 parts by weight |
| polymethylpentene resin particles (particle size distribution: 1 to 4 μm): | 15 parts by weight |

About each of the fillers used in the thermal insulation layer s of the thermal transfer image receiving sheets of Examples 12 to 16, the Coulter Counter method demonstrated that the average particle diameter was from 1 μm to 4 μm, and the following particle size distribution was generated: a particle size distribution, in which the amount of the filler 1 μm or less in size was 15% or less and that of the filler 3 μm or more in size was 15% or less. About the calcium carbonate filler used in Example 15, a commercially available product was adjusted so as to have the above-mentioned particle size distribution.

Comparative Example 6

A thermal transfer image receiving sheet of Comparative Example 6 was yielded in the same way as in Example 12 except that the thermal insulation layer forming resin in Example 12 was changed to have a composition described below.

⟨Thermal Insulation Layer Forming Resin (Comparative Example 6)⟩

| | |
|---|---|
| Polyester resin (DIANITEMA-521H, manufactured by Mitsubishi Rayon Co., Ltd.): | 85 parts by weight |
| calcium carbonate (PO-120-B-10, manufactured by SHIRAISHI CALCIUM KAISHA, LTD., particle size distribution: 0.5 to 13 μm): | 15 parts by weight |

Comparative Example 7

A thermal transfer image receiving sheet of Comparative Example 2 was yielded in the same way as in Example 12 except that the thermal insulation layer forming resin in Example 12 was changed to have a composition described below.

⟨Thermal Insulation Layer Forming Resin (Comparative Example 7)⟩

| | |
|---|---|
| Polyester resin (DIANITEMA-521H, manufactured by Mitsubishi Rayon Co., Ltd.): | 85 parts by weight |
| Acryl particles (manufactured by Soken Chemical & Engineering Co., Ltd., particle size distribution: 0.6 to 12 μm): | 15 parts by weight |

Comparative Example 8

A thermal transfer image receiving sheet of Comparative Example 8 was yielded in the same way as in Example 12 except that the draw ratio by area in Example 12 was set to 3.5.

(Evaluation)

Next, the following evaluations were made about the thermal transfer image receiving sheets of the working examples and the comparative examples.

(Print Sensitivity)

The print sensitivity was evaluated in the same way as described above.

(Density and Void Ratio of the Thermal Insulation Layers)

About the thermal transfer image receiving sheet obtained in each of the working examples and the comparative examples, the density (ρ) of the thermal insulation layer in the film layer having voids was measured. The void ratio (V) of the thermal insulation layer in the thermal transfer image receiving sheet obtained in each of the working examples and the comparative examples was calculated by use of the following: void ratio $(V)=(1-\rho/\rho_0)\times 100$ (%), in which "ρ" represents the density of the thermal insulation layer, and "$\rho_0$" represents the density of the whole of the resin, the filler, and other solid components which constituted the thermal insulation layer.

The above-mentioned evaluation results are as shown in Table 2 described below.

TABLE 2

| Test sample | Thermal insulation layer density ($g/cm^3$) | Thermal insulation layer void ratio (%) | Print density |
|---|---|---|---|
| Example 12 | 0.62 | 51 | ○ |
| Example 13 | 0.85 | 35 | ○ |
| Example 14 | 0.72 | 44 | ○ |
| Example 15 | 0.71 | 44 | ○ |
| Example 16 | 0.64 | 46 | ○ |
| Comparative Example 6 | 1.05 | 23 | X |
| Comparative Example 7 | 1.02 | 24 | X |
| Comparative Example 8 | 1.15 | 6 | X |

As shown in the table described above, the printed matters of the working examples each exhibited such a high density that the maximum reflection density was 2.0 or more, and each gave a high resolution image. On the other hand, each of the printed matters of the comparative examples exhibited a maximum reflection density of less than 2.0, which was not satisfactory as a highest print density. About the thermal insulation layers manufactured in the working examples, which had voids, the void ratios were from 35% to 51%, and the densities was from 0.62 $g/cm^3$ to 0.85 $g/cm^3$ or less. Thus, the layers were layers having appropriate voids. On the other hand, about the thermal insulation layers manufactured in the comparative examples, the void ratios were each less than 25%, and the densities were from 1.02 $g/cm^3$ to 1.15 $g/cm^3$. Thus, it is judged that appropriate voids were not generated.

The invention claimed is:

1. A thermal transfer image receiving sheet, comprising: a substrate sheet; and an image receiving layer which is formed on the substrate sheet and comprising a binder resin, a high molecular weight silicone, and a low molecular weight-modified silicone, wherein a content of the high molecular weight silicone ranges from 0.1 to 10 parts by weight for 100 parts by weight of the binder resin and a content of the low molecular weight-modified silicone ranges from 0.1 to 10 parts by weight for 100 parts by weight of the binder resin, and wherein a kinematic viscosity of the high molecular weight silicone is 500000 $mm^2/s$ or more, and a kinematic viscosity of the low molecular weight-modified silicone ranges from 100 $mm^2/s$ to 100000 $mm^2/s$.

2. The thermal transfer image receiving sheet according to claim 1, wherein a mass ratio of the high molecular weight silicone image receiving layer to the low molecular weight-modified silicone in the image receiving layer (mass of the high molecular weight silicone:mass of the low molecular weight-modified silicone) ranges from 1:4 to 4:1.

* * * * *